US010386149B1

(12) United States Patent
Facchini et al.

(10) Patent No.: US 10,386,149 B1
(45) Date of Patent: Aug. 20, 2019

(54) FIREARM SYSTEM

(71) Applicant: FIMS Manufacturing Corp., Oakland, NJ (US)

(72) Inventors: Michael Facchini, Oakland, NJ (US); Matthew Steinhauser, Oakland, NJ (US)

(73) Assignee: FIMS Manufacturing Corp., Oakland, NJ (US)

( * ) Notice: Subject to any disclaimer, the term of this patent is extended or adjusted under 35 U.S.C. 154(b) by 3 days.

(21) Appl. No.: 16/007,366

(22) Filed: Jun. 13, 2018

(51) Int. Cl.

| | |
|---|---|
| ***F41A 21/48*** | (2006.01) |
| ***F41C 23/16*** | (2006.01) |
| ***F41A 5/26*** | (2006.01) |
| ***F41A 3/66*** | (2006.01) |

(52) U.S. Cl.
CPC ..... *F41A 21/48* (2013.01); *F41A 3/66* (2013.01); *F41A 5/26* (2013.01); *F41C 23/16* (2013.01)

(58) Field of Classification Search
CPC ..... F41A 21/484; F41A 21/48
USPC ..... 42/75.02
See application file for complete search history.

(56) References Cited

U.S. PATENT DOCUMENTS

| | | | | |
|---|---|---|---|---|
| 2,951,424 A | | 9/1960 | Stoner | |
| 5,685,102 A | * | 11/1997 | Latka | F41A 21/325 42/76.01 |
| 8,931,198 B2 | * | 1/2015 | Aalto | F41A 21/48 42/75.02 |
| 9,964,374 B1 | * | 5/2018 | Facchini | F41A 21/484 |
| 2018/0172384 A1 | * | 6/2018 | Maffett | F41A 21/484 |

* cited by examiner

*Primary Examiner* — Reginald S Tillman, Jr.
(74) *Attorney, Agent, or Firm* — John H. Choi & Associates

(57) ABSTRACT

A firearm system capable of easily attaching and detaching an upper receiver and a barrel is disclosed. The upper receiver is operably coupled to a bearing case. A plurality of bearings are positioned on the bearing case for engaging dimpled slots on the surface of the barrel. A spring sleeve is engageable with the biasing member and circumscribes the bearing case, biasing member and bearings. A dust cover is engageable with the spring sleeve. In an engaged state, the bearing case, the spring sleeve, and the dust cover are assembled such that the upper receiver and barrel are substantially aligned.

19 Claims, 32 Drawing Sheets

FIREARM SYSTEM

FIELD

The present disclosure relates to firearm accessories and in particular to a barrel coupling mechanism to form a firearm system.

BACKGROUND

Over the years, it has become essential that firearms, like many other devices, be capable of convenient and discrete transport. Although handguns are fairly easy to store and transport in compact carrying cases, it is not as easy to do so with rifles with longer barrels.

Therefore, some rifles have been manufactured with barrels that can be disassembled, i.e., rifles, so that smaller carrying cases could be utilized to transport the same. A rifle typically includes a lower receiver assembly, an upper receiver assembly, a barrel and a coupling mechanism for coupling the barrel to the upper receiver assembly. The M-16 style rifle is a type of rifle system commonly used by military and law enforcement that features a gas-operated bolt and bolt carrier system, as disclosed, for example, in U.S. Pat. No. 2,951,424, issued to Eugene M. Stoner on Sep. 6, 1960 (incorporated herein by reference in its entirety). The AR-15 style rifle is a similarly designed rifle system commonly sold and used in civilian applications.

For most M-16/AR-15 style rifle systems, the barrel is assembled by connecting the barrel to the upper receiver utilizing a barrel nut through threaded engagement. The barrel nut must be appropriately torqued to properly align the barrel and completely tighten the barrel nut, typically requiring the use of specialized tools and a bench vise. Consequently, the barrel cannot be quickly or easily removed, changed, or assembled in the field under combat conditions or exigent circumstances, and the rifle system cannot be quickly and easily stored in a disassembled state.

In response to the problems associated with the traditional threaded engagement of the barrel and upper receiver, various devices and mechanisms that do not require tools for assembly and disassembly have been introduced in the market. A popular alternative is a tool-free retrofitted coupling mechanism meant to reduce time to assemble and disassemble the rifle. However, even though they are tool-free, the coupling mechanisms in the prior art pose several disadvantages.

First, it is difficult to accomplish a secure fit when assembled. Not only is a secure fit critical to the rifle's proper function but a non-secure fit is a major safety hazard.

Second, the inside of the barrel could be exposed to dust and debris because the coupling mechanisms of the prior art are not completely sealed when in use. Again, this could be detrimental to the proper function of the rifle as well as to the safety of the user.

Third, the coupling mechanisms of the prior art often times require additional fabrication on the existing barrel and upper receiver, for example, fabrication or modification of existing threads. Hence, the user may not be able to install the coupling mechanism himself and additional costs for installation might be required.

Fourth, the coupling mechanisms of the prior art are recognizable as being components separate from the rest of the firearm. Such coupling mechanism are obviously separate components.

Fifth, gas tubes for conveying discharge gases are separate from the coupling mechanisms of the prior art, and so the gas tubes are extra components requiring complex assembly in conjunction with the coupling mechanisms.

Therefore, a need exists for a coupling mechanism that can be easily installed, and for quickly and easily attaching and detaching a barrel of a firearm while providing a secure attachment during use, as well as disguised, not recognizable, and not obviously components separate from the remainder of the firearm. In addition, a need exists for a coupling mechanism which is easily integrated with the coupling mechanism.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The barrel coupling mechanism of the present invention solves the problems of the prior art and provides additional advantages. The barrel coupling mechanism of the present invention provides for a barrel of a firearm to be securely assembled and quickly disassembled without any tools.

In general, the barrel coupling mechanism of the present invention includes a ball bearing case fixedly coupled with an upper receiver of a firearm. The ball bearing case is configured such that a biasing member is positioned and secured at a lower end thereof. The ball bearing case includes a plurality of slots for each housing a ball bearing. The ball bearings and biasing member are further secured within the ball bearing case by a spring sleeve, which circumscribes the ball bearing case and is engaged with the biasing member. The spring sleeve is self-secured onto the ball bearing case by virtue of limited clearance between the spring sleeve inner end and the upper receiver, and limited clearance between the spring sleeve outer end and the ball bearings. A barrel sleeve is fixedly coupled on one end to an end of a barrel. On an opposite end, the barrel sleeve includes a plurality of grooves for engagement with the ball bearings located on the ball bearing case.

In operation, the barrel sleeve is inserted into spring sleeve and ball bearing case while the spring sleeve is retracted, thereby releasing the ball bearings radially outward. The spring sleeve is released and the ball bearings engage the barrel sleeve grooves, thereby forming a secure coupling between the barrel and upper receiver of the firearm. To disassemble, the spring sleeve is retracted such that the ball bearings disengage from the barrel sleeve grooves. The barrel sleeve is then removed from the spring sleeve and ball bearing case.

In one embodiment, the present invention includes a firearm system comprising: an upper receiver, the upper receiver having a free end, the free end having first threads circumscribing an outer section thereof; a bearing case comprising an upper member and a lower member, the upper member having an inner diameter less than an inner diameter of the lower member such that an upper surface is formed therebetween, the lower member having a plurality of slots formed therein, the upper member having second threads circumscribing an inner section thereof, the bearing case operably coupled to the upper receiver free end by engagement of the first and second threads; a plurality of bearings, each bearing positioned within each slot; a spring sleeve circumscribing the bearing case, a biasing member and the bearings, the spring sleeve having a pocket engaged with the biasing member; and a barrel having an upper end, an opposing lower end, a longitudinal axis, a groove therebetween for receiving a first fastener, and a plurality of dimples for receiving the bearings; wherein in an engaged state, the upper end of the barrel is positioned within the bearing case such that each bearing is positioned within a corresponding dimple such that the upper receiver and barrel are substantially aligned. Each slot of the bearing case extends through the lower member such that a corresponding bearing is at least partially extendable therethrough. The spring sleeve comprises an upper member integrally formed with a lower member, the lower member having an inner surface with notches engageable with the bearings. The lower member of the bearing case has a curved inner lip for receiving the upper end of the barrel. A dust cover is engageable with the spring sleeve to form a substantial seal. At least one of the spring sleeve and the dust cover has a longitudinally extending aperture for receiving a gas tube passing therethrough.

A handguard and a handguard adaptor are included, wherein the first fastener is secured into the groove on the barrel to prevent at least one of the handguard and the handguard adaptor from moving longitudinally. The handguard further comprises at least one aperture extending radially therethrough such that a second fastener is disposed therein to secure the handguard to the handguard adaptor. The handguard adaptor further comprises at least one aperture extending radially therethrough such that a second fastener is disposed therein to secure the handguard adaptor to the barrel. The lower member of the bearing case has a first predetermined exterior shape; and wherein an upper member of the handguard adaptor has a second predetermined exterior shape complementary with the first predetermined exterior shape, thereby forming a substantial seal when the upper member of the handguard adaptor substantially abuts the lower member of the bearing case. The handguard has a longitudinally extending aperture for receiving a gas tube passing therethrough.

In an alternative embodiment, the present invention includes a firearm system comprising: an upper receiver, the upper receiver having a free end, the free end having first threads circumscribing an outer section thereof; a bearing case comprising an upper member and a lower member, the upper member having an inner diameter less than an inner diameter of the lower member such that an upper surface is formed therebetween, the lower member having a plurality of slots formed therein, the upper member having second threads circumscribing an inner section thereof, the bearing case operably coupled to the upper receiver free end by engagement of the first and second threads; a plurality of bearings, each bearing positioned within each slot; a spring sleeve circumscribing the bearing case, a biasing member and the bearings, the spring sleeve having a pocket engaged with the biasing member; a dust cover engageable with the spring sleeve to form a substantial seal; a barrel having an upper end, an opposing lower end, a longitudinal axis, a groove therebetween for receiving a first fastener, and a plurality of dimples for receiving the bearings; a handguard; and a handguard adaptor; wherein the first fastener is secured into the groove on the barrel to prevent at least one of the handguard and the handguard adaptor from moving longitudinally; and wherein in an engaged state, the upper end of the barrel is positioned within the bearing case such that each bearing is positioned within a corresponding dimple such that the upper receiver and barrel are substantially aligned. Each slot of the bearing case extends through the lower member such that a corresponding bearing is at least partially extendable therethrough. The handguard further comprises at least one aperture extending radially therethrough such that a second fastener is disposed therein to secure the handguard to the handguard adaptor. The handguard adaptor further comprises at least one aperture extending radially therethrough such that a second fastener is disposed therein to secure the handguard adaptor to the barrel. The lower member of the bearing case has a first predetermined exterior shape; and wherein an upper member of the handguard adaptor has a second predetermined exterior shape complementary with the first predetermined exterior shape, thereby forming a substantial seal when the upper member of the handguard adaptor substantially abuts the lower member of the bearing case.

In another alternative embodiment, the present invention includes a method for using a firearm system having an upper receiver and a barrel, the barrel having an upper end with a dimple, with the method comprising: providing a bearing case and a spring sleeve circumscribing the bearing case, the bearing case having a slot for receiving a bearing, and the spring sleeve for applying inward radial pressure on the bearing in the slot; attaching the bearing case to an upper end of the upper receiver; moving the spring sleeve toward the upper receiver, thereby moving the spring sleeve away from the bearing to allow the bearing to move radially outward from the slot a minimal distance; inserting the barrel into the bearing case until the dimple engages the bearing, thereby moving the bearing radially inward; and moving the spring sleeve away from the upper receiver to the spring sleeve towards the bearing to move the bearing radially inward, thereby securing the barrel in the bearing case. The method also includes providing a dust cover circumscribing the spring sleeve. The method also includes fastening a handguard to a groove of the barrel by a fastener. The method further includes moving the spring sleeve toward the upper receiver, thereby moving the spring sleeve away from the bearing to allow the bearing to move radially outward from the slot a minimal distance; and moving the barrel longitudinally away from the bearing case until the dimple disengages the bearing, thereby disengaging the barrel from the upper receiver.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In addition, some of the figures are provided further details including exemplary dimensions which are in units of inches.

In the drawings.

Figure 1:
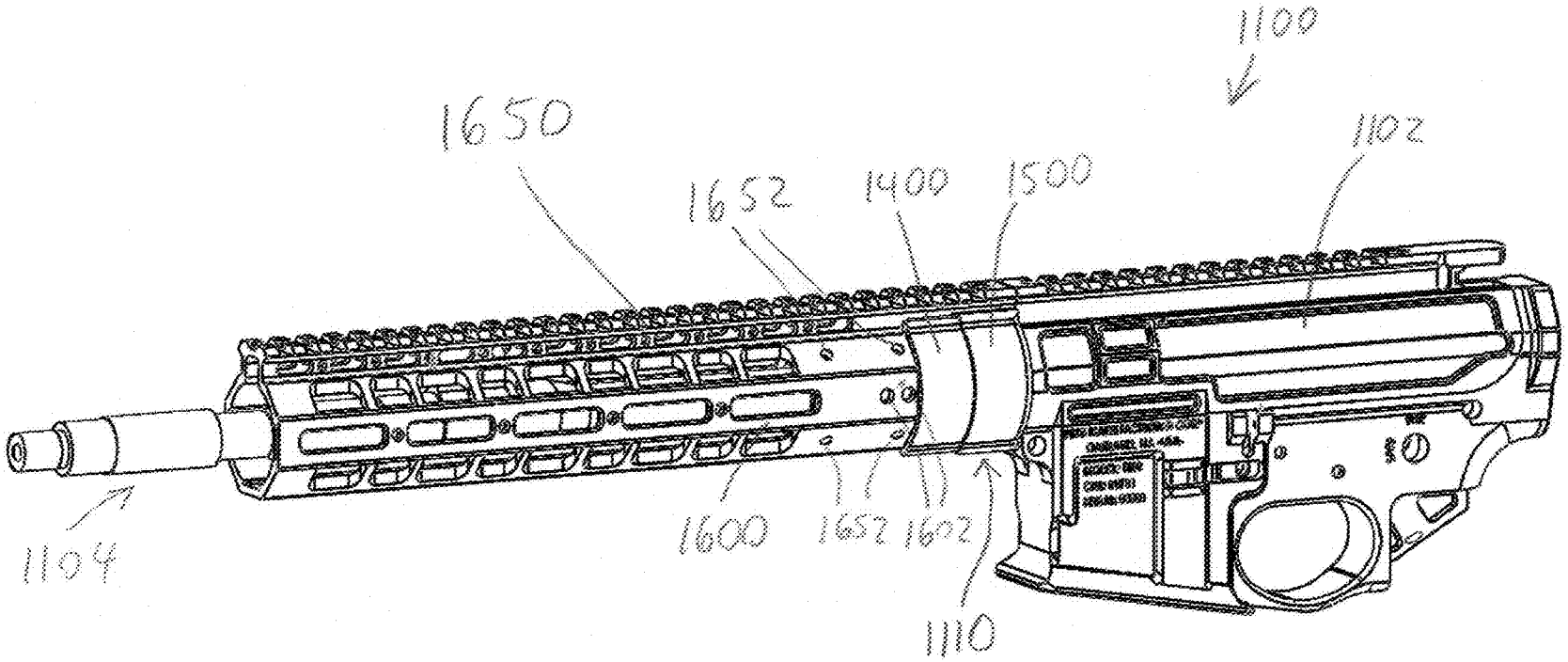
FIG. 1 is a top front side perspective view of an embodiment of a firearm of the present invention with a coupling mechanism including a bearing case, a spring sleeve, and a dust cover.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Figure 3:
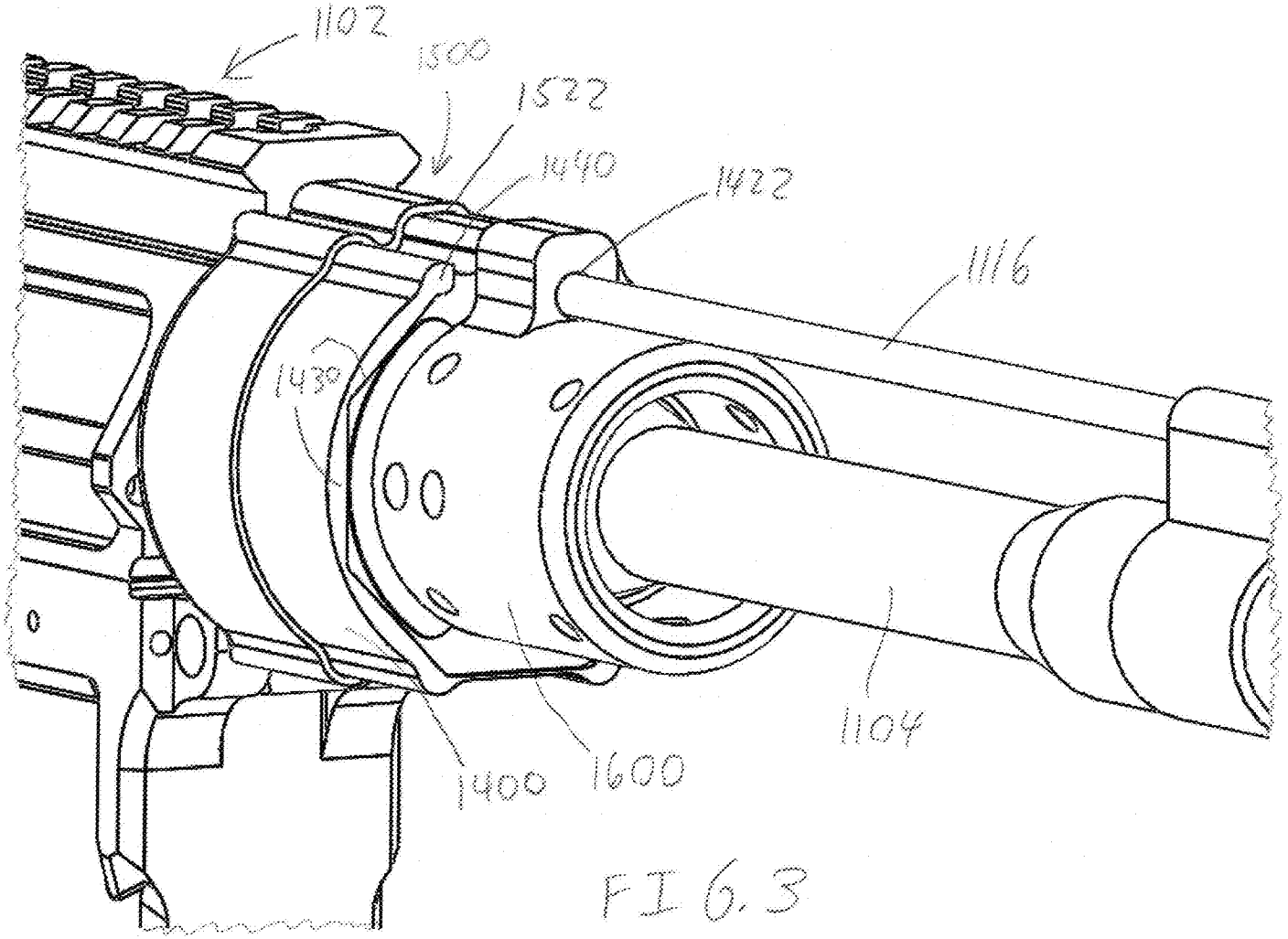
FIG. 3 is a top front side perspective view of the coupling mechanism with a handguard adaptor.
Figure 4:
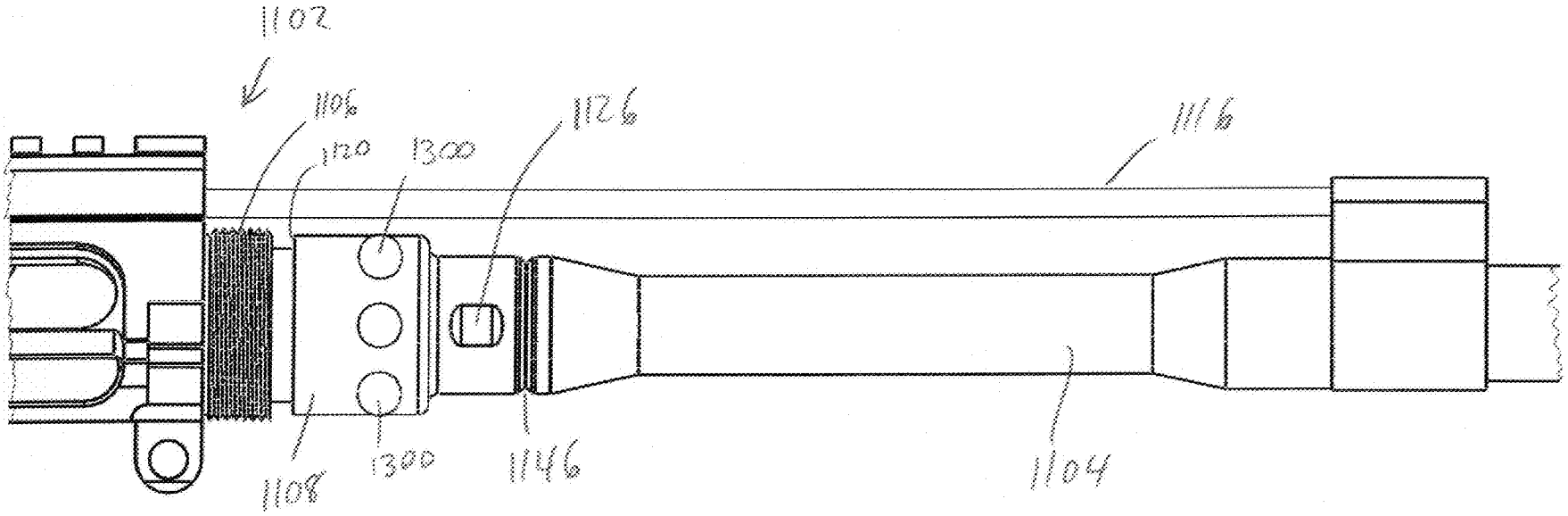
FIG. 4 is a side plan view of the barrel mounted to the upper receiver without the coupling mechanism.
Figure 32:
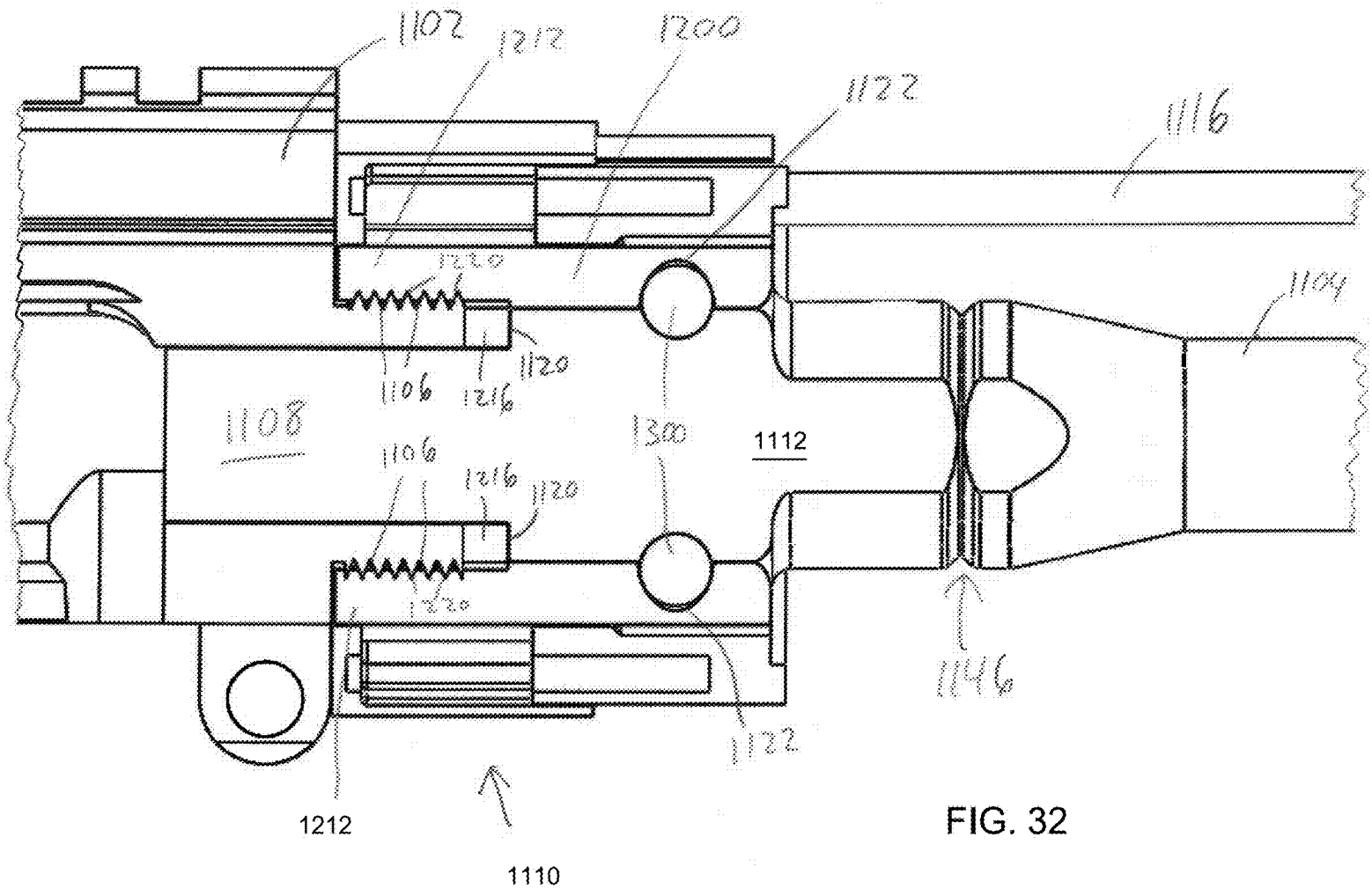
FIG. 32 is a side cut-away view of the coupling mechanism with ball bearings in a third position with the barrel inserted into the coupling mechanism.

In the embodiment shown in FIGS. 1-32, a barrel coupling mechanism or device 1110 of the present invention is shown which provides the user the ability to quickly attach and detach a barrel or barrel portion 1104 from and to an upper receiver 1102 of a firearm 1100. In general, the barrel coupling mechanism 1110 includes a ball bearing case 1200, shown in FIG. 6, coupled with an upper receiver 1102 of a firearm 1100, as shown for example in FIGS. 1 and 7. The ball bearing case 1200 is configured to be screwed onto threads 1106 of the upper receiver 1102, as shown in FIGS. 4 and 9, with the barrel portion 1104 inserted into the ball bearing case 1200 and the upper receiver 1102, and secured therein by ball bearings 1202, as shown in FIG. 32.

Figure 10:
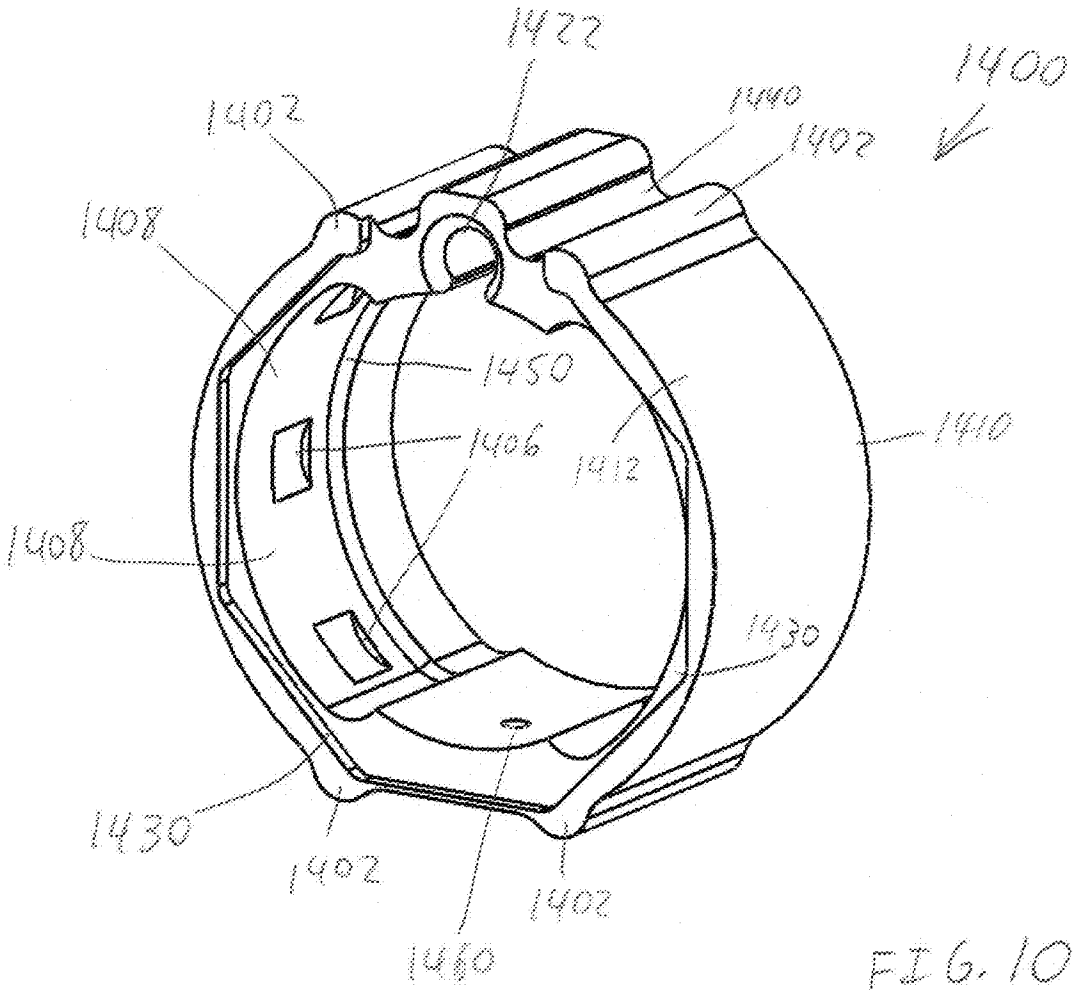
FIG. 10 is a top front side perspective view of the spring sleeve.
Figure 11:
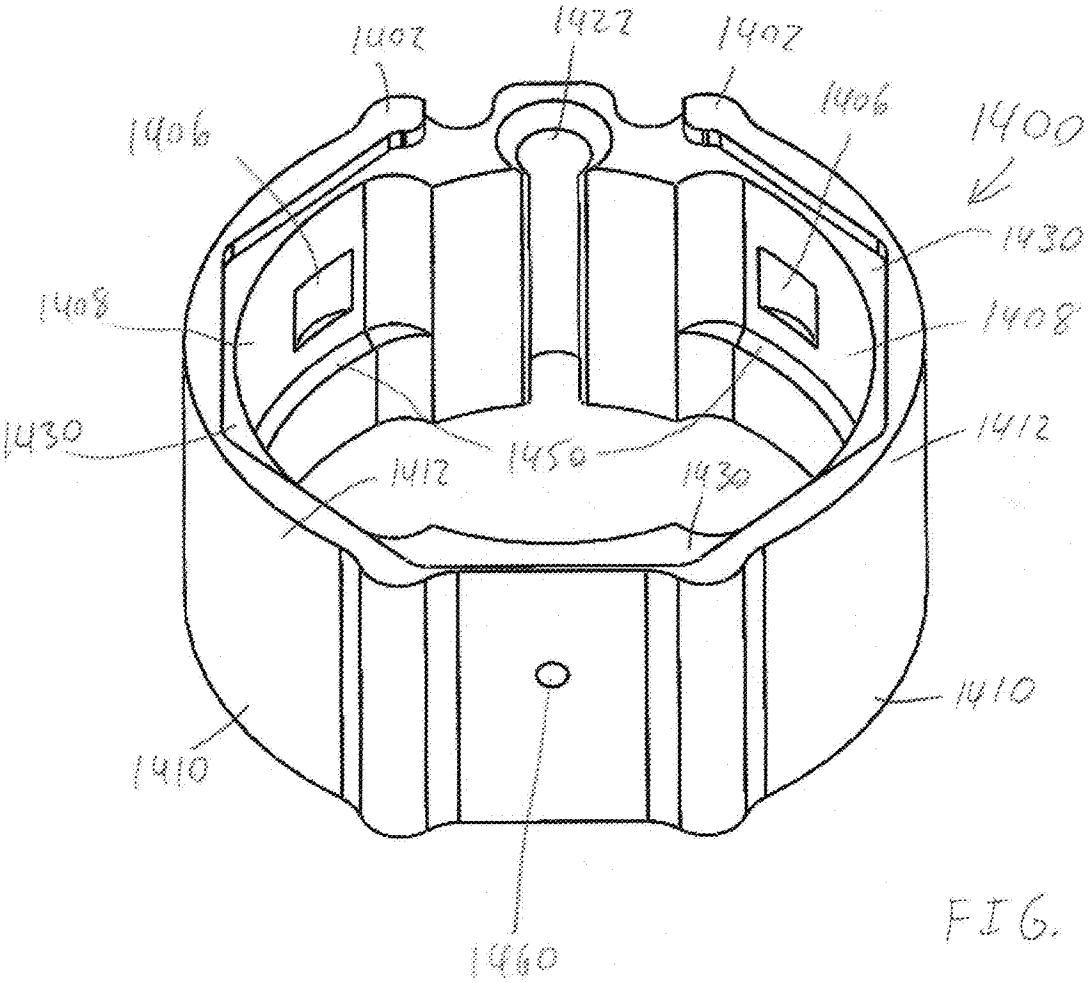
FIG. 11 is a bottom front perspective view of the spring sleeve of FIG. 10.
Figure 12:
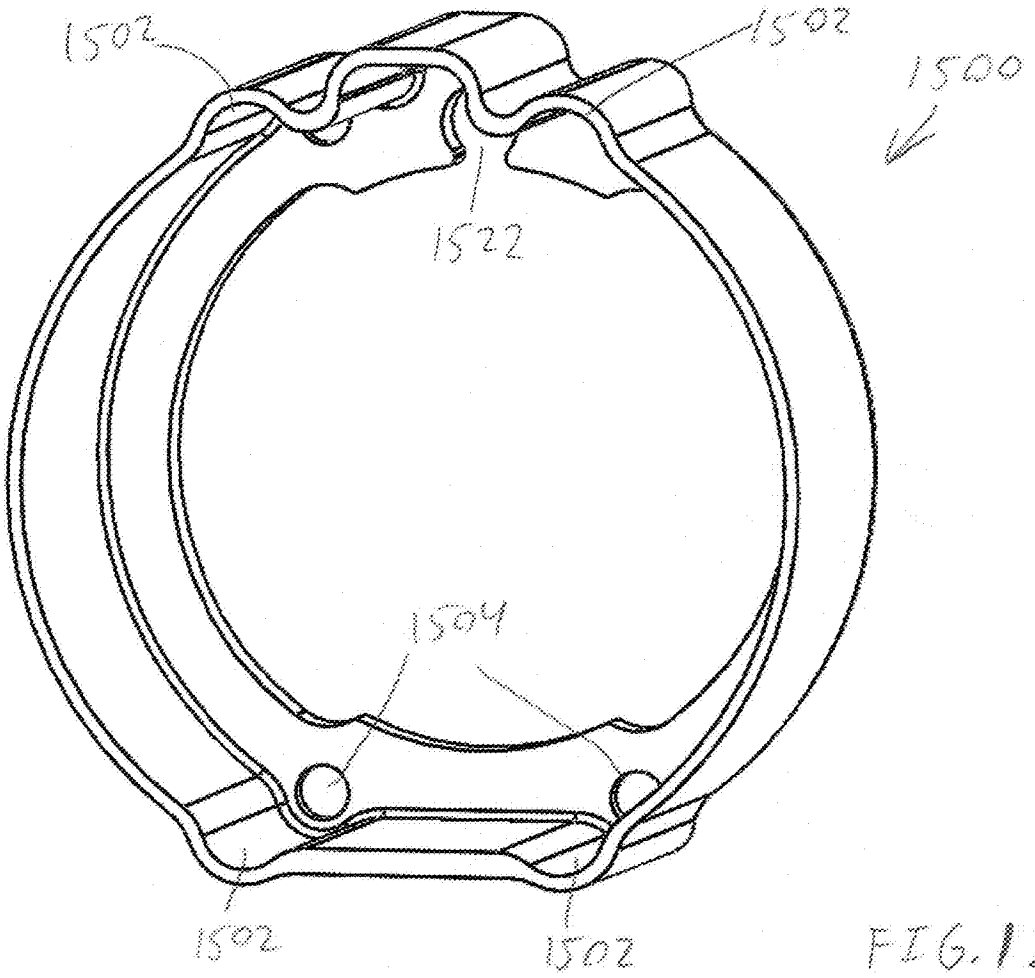
FIG. 12 is a top front side perspective view of the dust cover.
Figure 13:
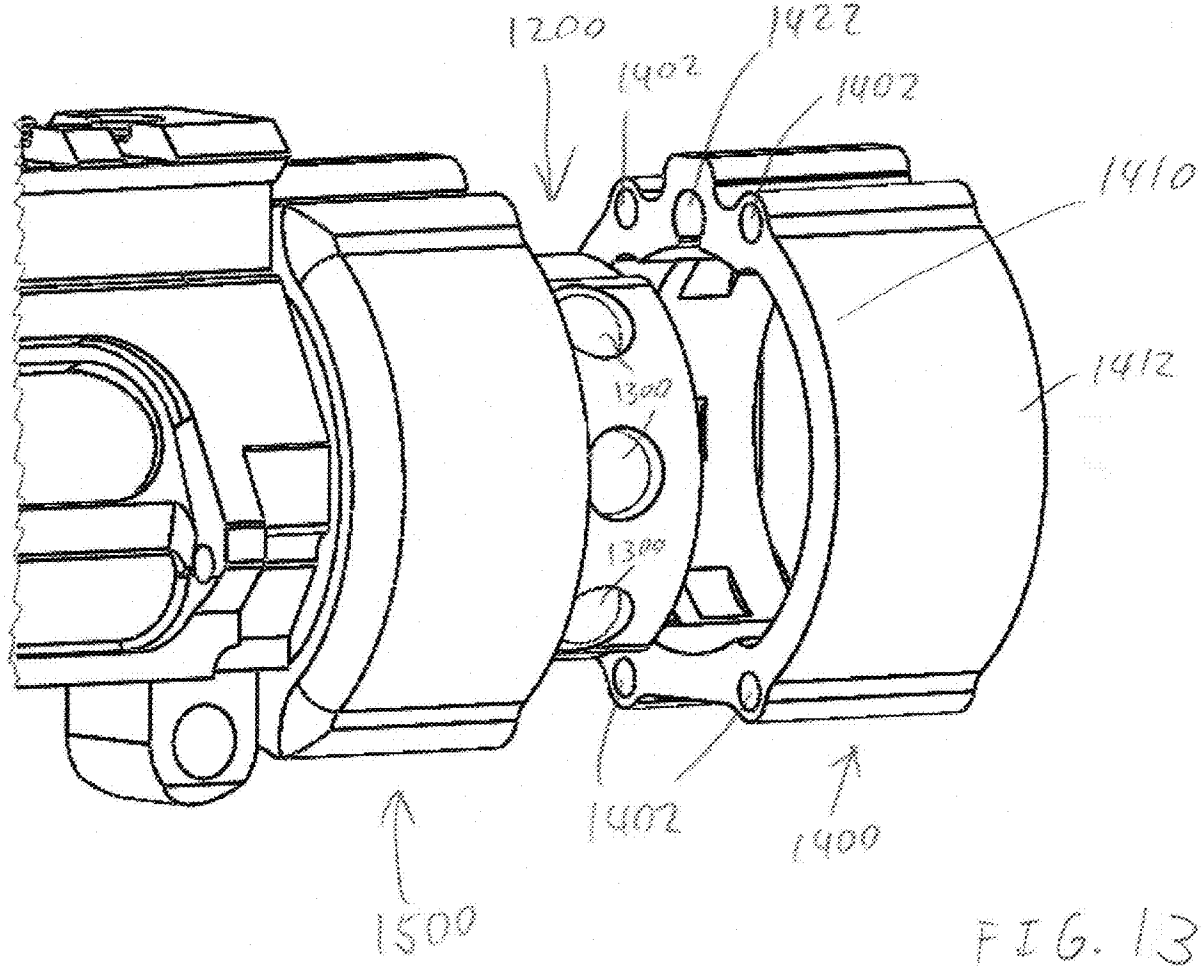
FIG. 13 is a top front side perspective view of the coupling mechanism with the spring sleeve separated from the coupling mechanism.

The ball bearing case 1200 is surrounded by a spring sleeve 1400, as shown in FIGS. 10-11, which is biased away from the upper receiver 1102 by at least one biasing member (not shown) positioned and secured at a lower end of the spring sleeve 1400 in respective spring pockets 1402, as shown in FIGS. 10-11 and 13. For example, as shown in FIGS. 10 and 13, there may be four spring pockets 1402 spaced about the circumferential exterior of the spring sleeve 1400. In the exemplar embodiment, each biasing member (not shown) is a compression spring positioned in the spring pockets 1402, with an upper end of each biasing member positioned in slots 1502 and apertures 1504 of a dust cover 1500, shown in FIG. 12. As shown in FIGS. 13-16, the dust cover 1500 is disposed towards the upper receiver 1102 relative to the spring sleeve 1400, and the dust cover 1500 surrounds the spring sleeve 1400, with the dust cover 1500 biased towards the upper receiver 1102 by the biasing member. As shown in FIG. 13, the bearing case 1200, the spring sleeve 1400, and the dust cover 1500 have generally the same internal profile to keep the combination of components 1200, 1400, 1500 indexed properly to form a dust-proof coupling mechanism 1110.

Figure 22:
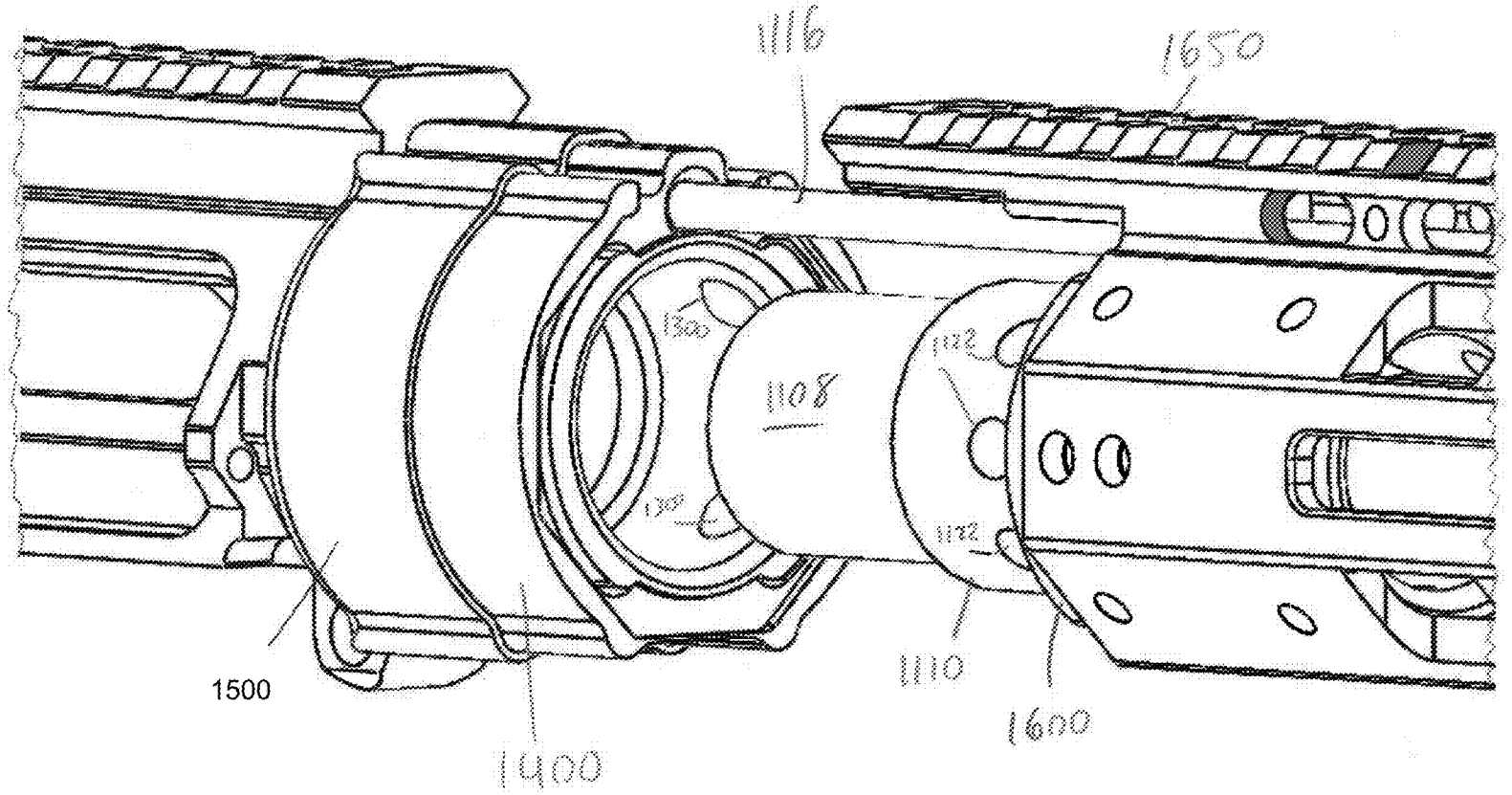
FIG. 22 is a top front side perspective view of the barrel and handguard of FIG. 20 with the barrel being inserted into the coupling mechanism.
Figure 23:
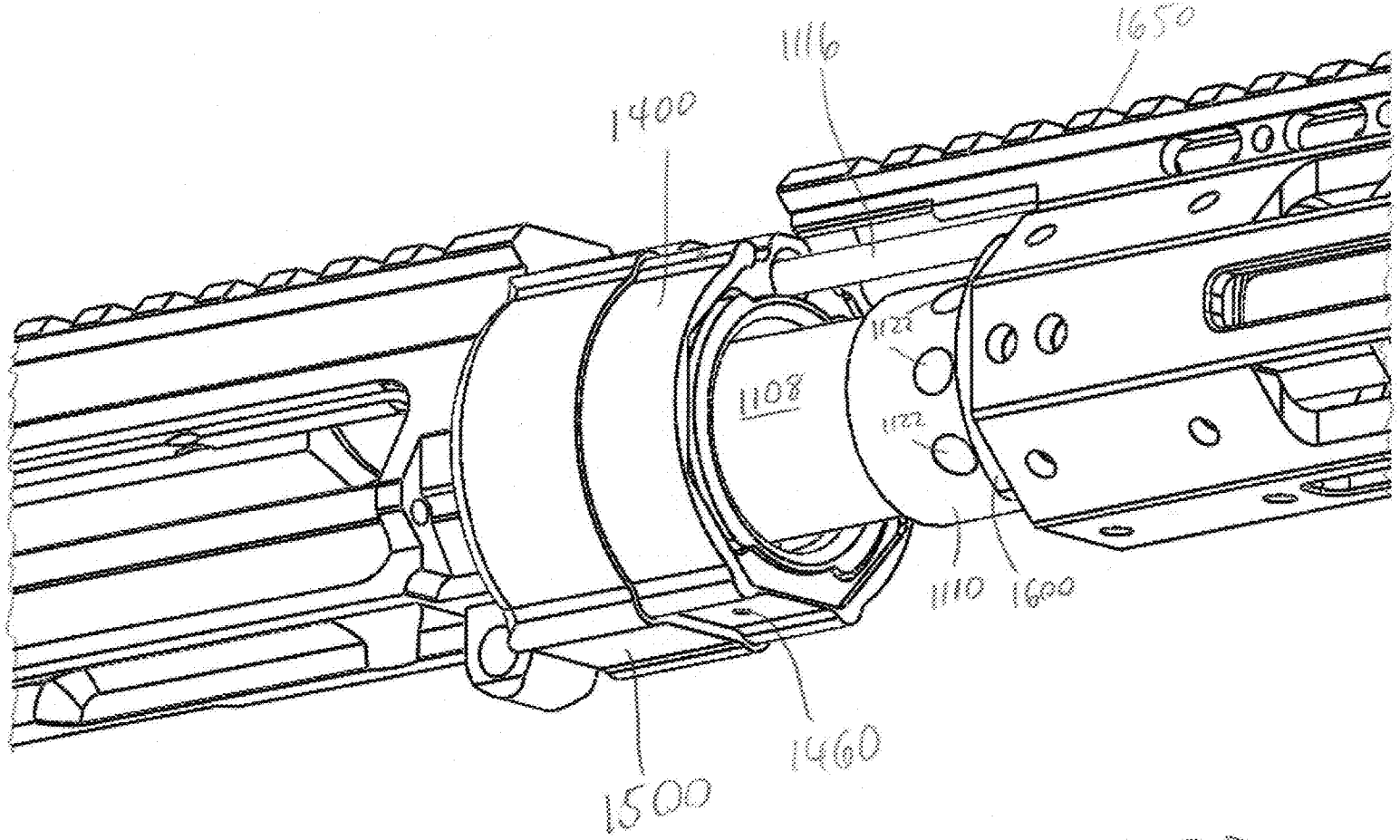
FIG. 23 is a bottom front side perspective view of the components of FIG. 22.
Figure 24:
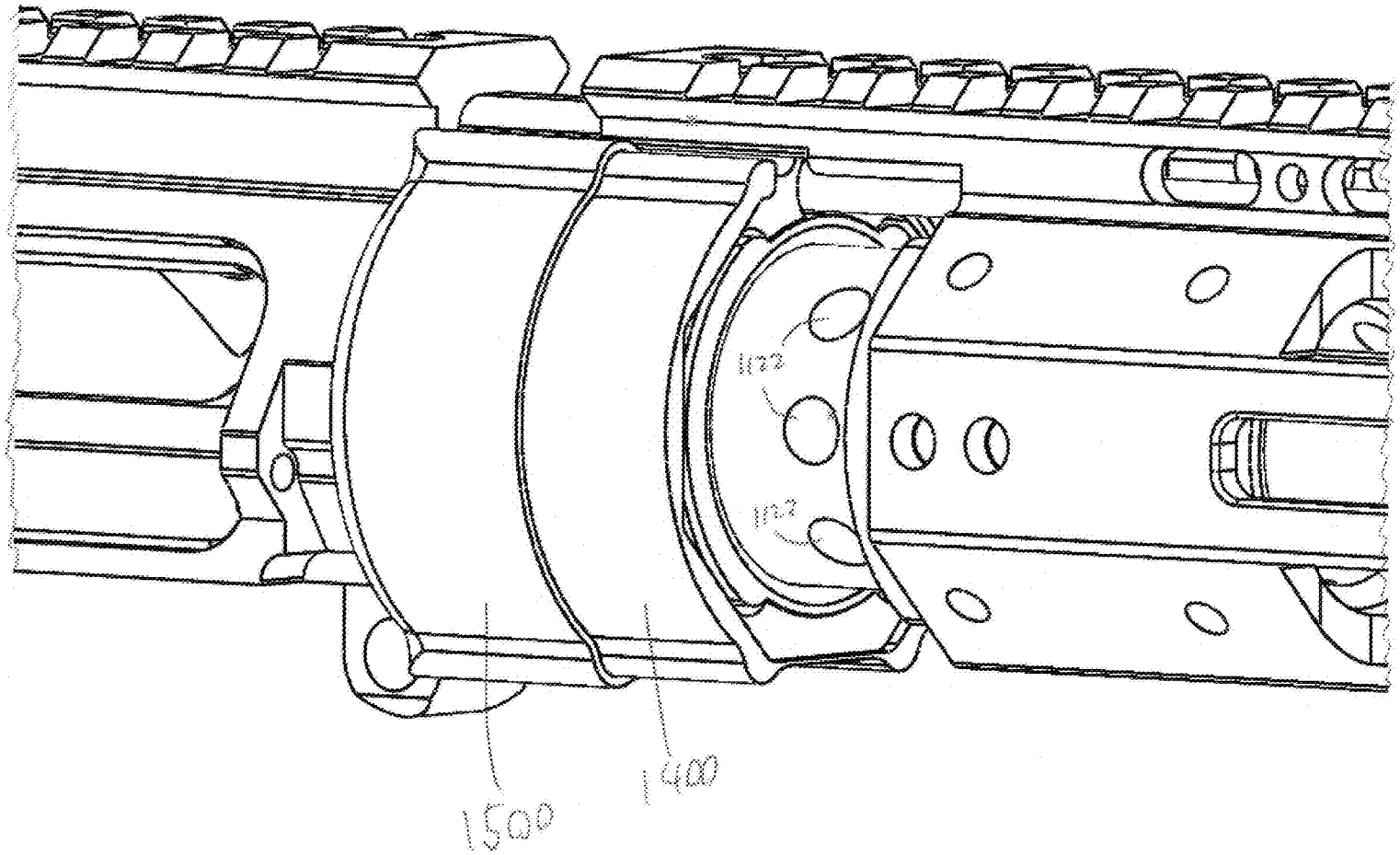
FIG. 24 is a top front side perspective view of the barrel and handguard of FIG. 20 with the barrel being further inserted into the coupling mechanism.
Figure 25:
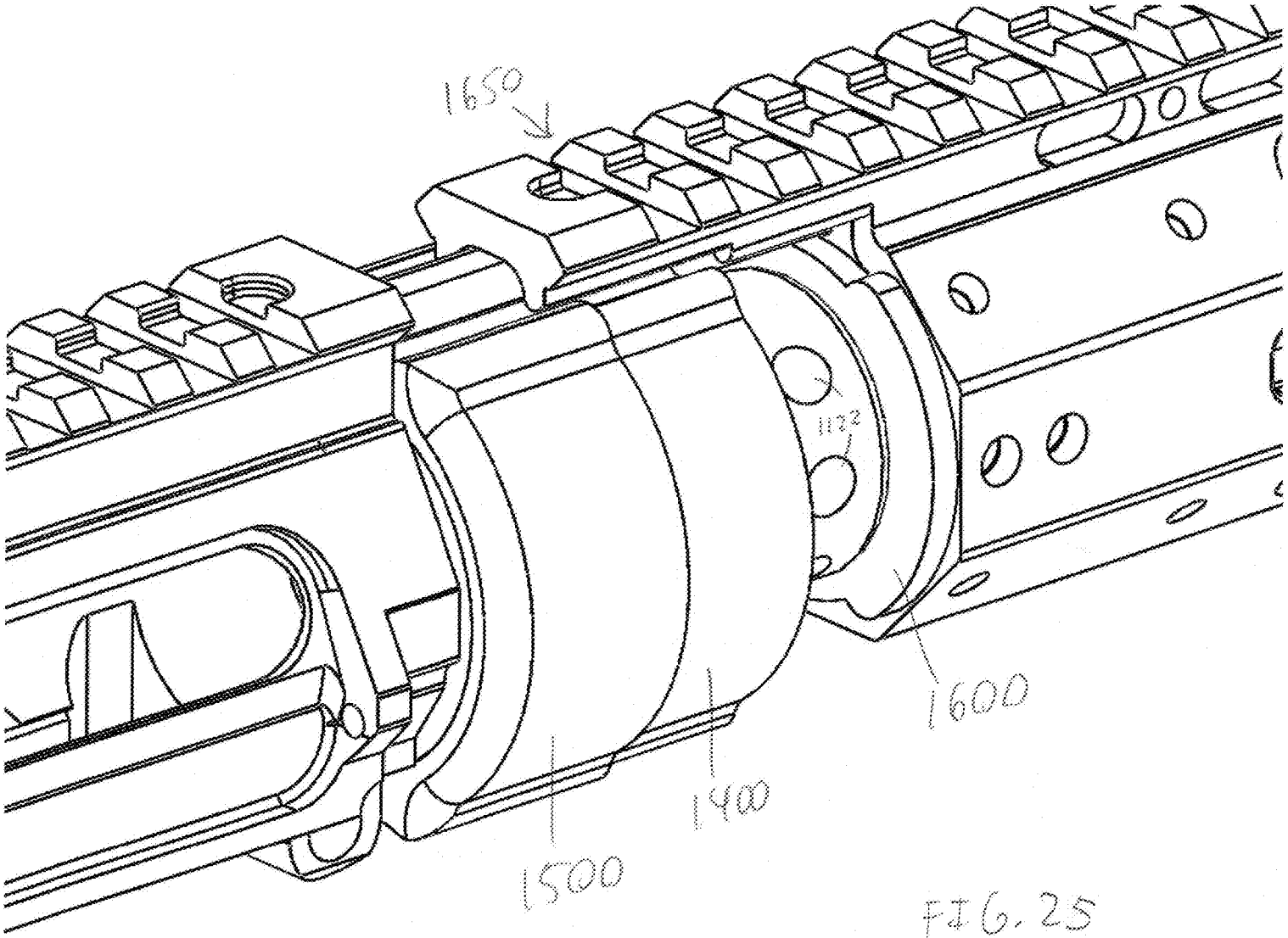
FIG. 25 is a top rear side perspective view of the barrel and handguard of FIG. 20 with the barrel being further inserted into the coupling mechanism.
Figure 26:
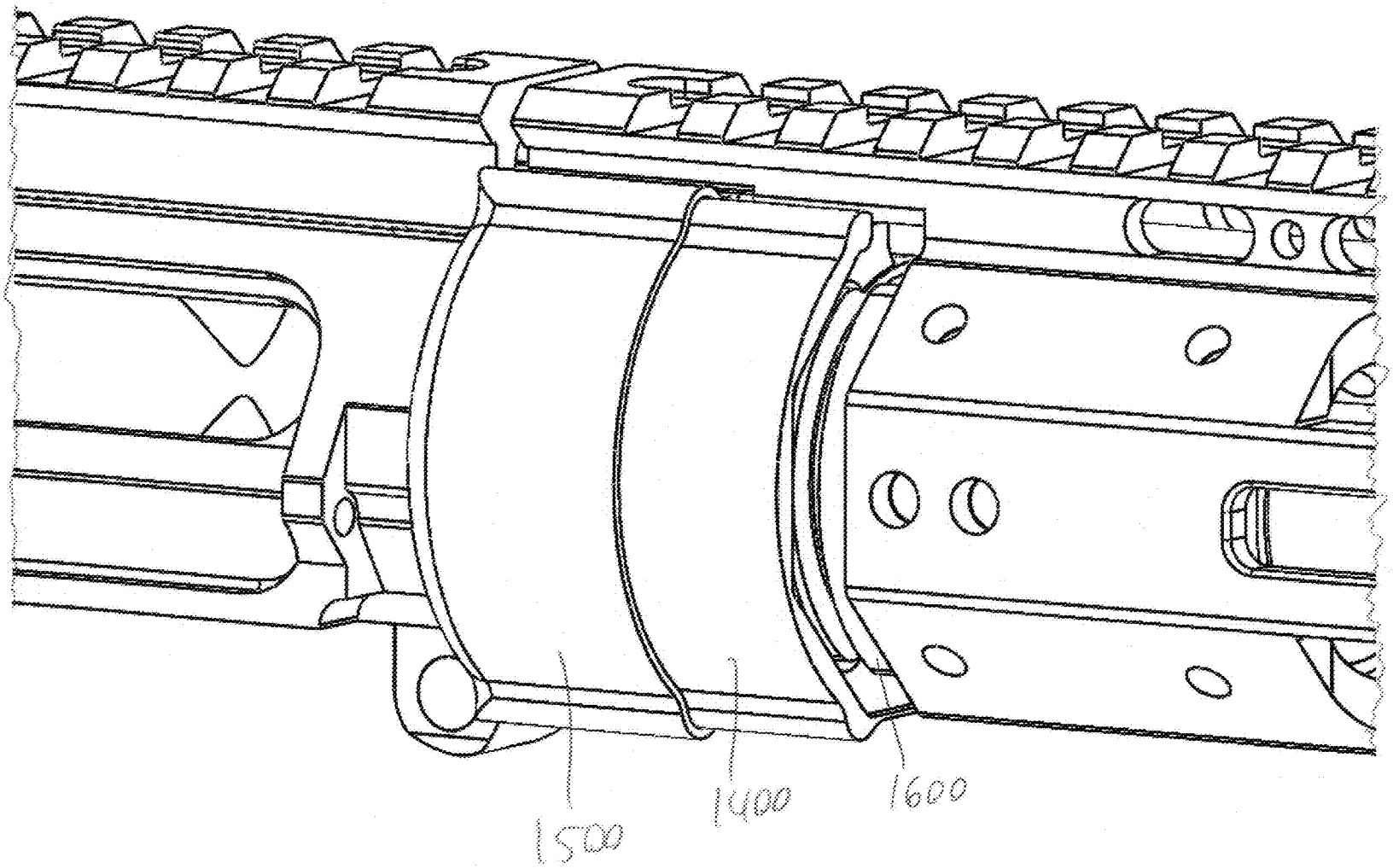
FIG. 26 is a top front side perspective view of the barrel and handguard of FIG. 20 with the barrel being almost completely inserted into the coupling mechanism.
Figure 27:
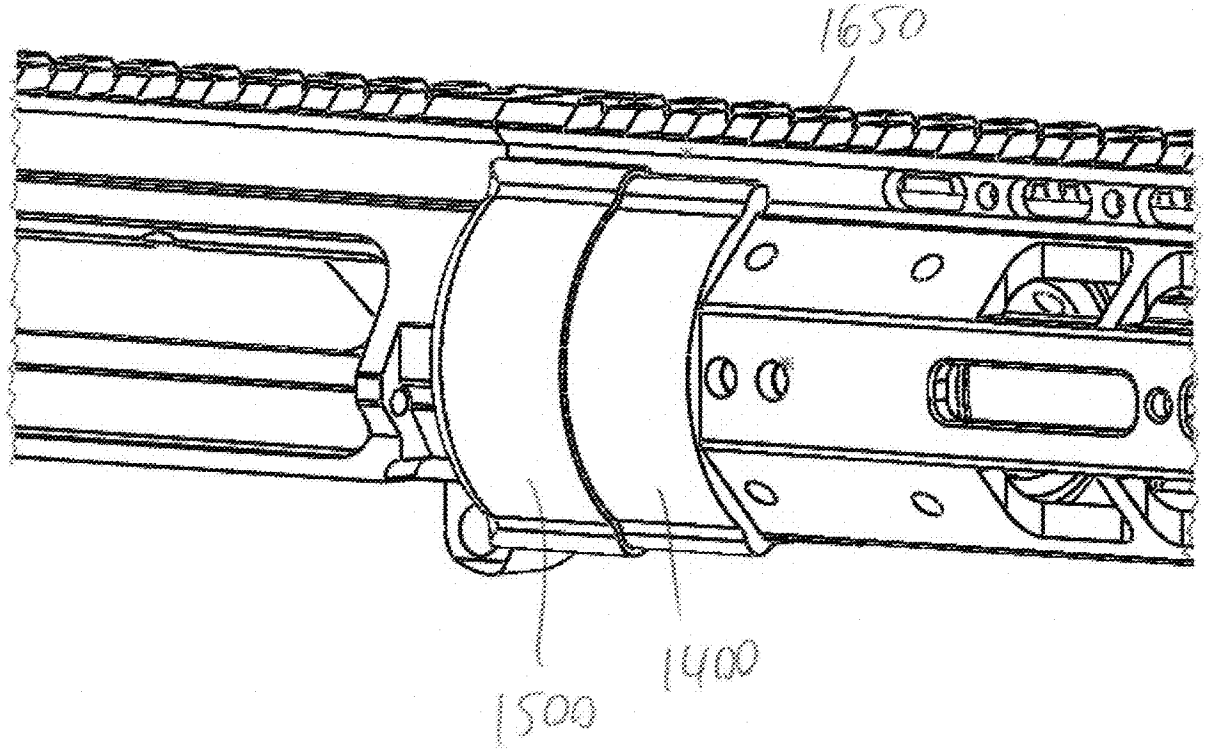
FIG. 27 is a top front side perspective view of the barrel and handguard of FIG. 20 with the barrel completely inserted into the coupling mechanism.
Figure 28:
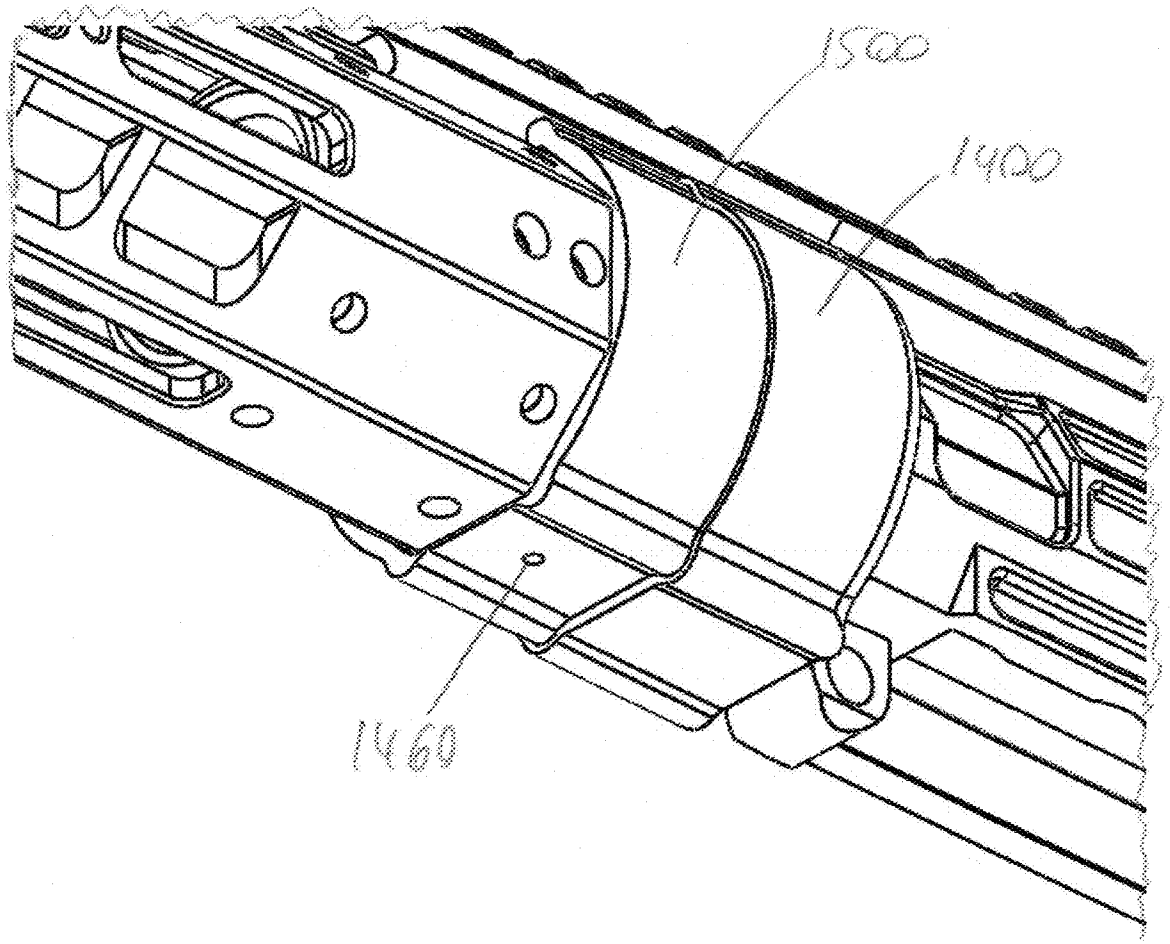
FIG. 28 is a bottom rear side perspective view of the barrel and handguard of FIG. 20 with the barrel completely inserted into the coupling mechanism.
Figure 29:
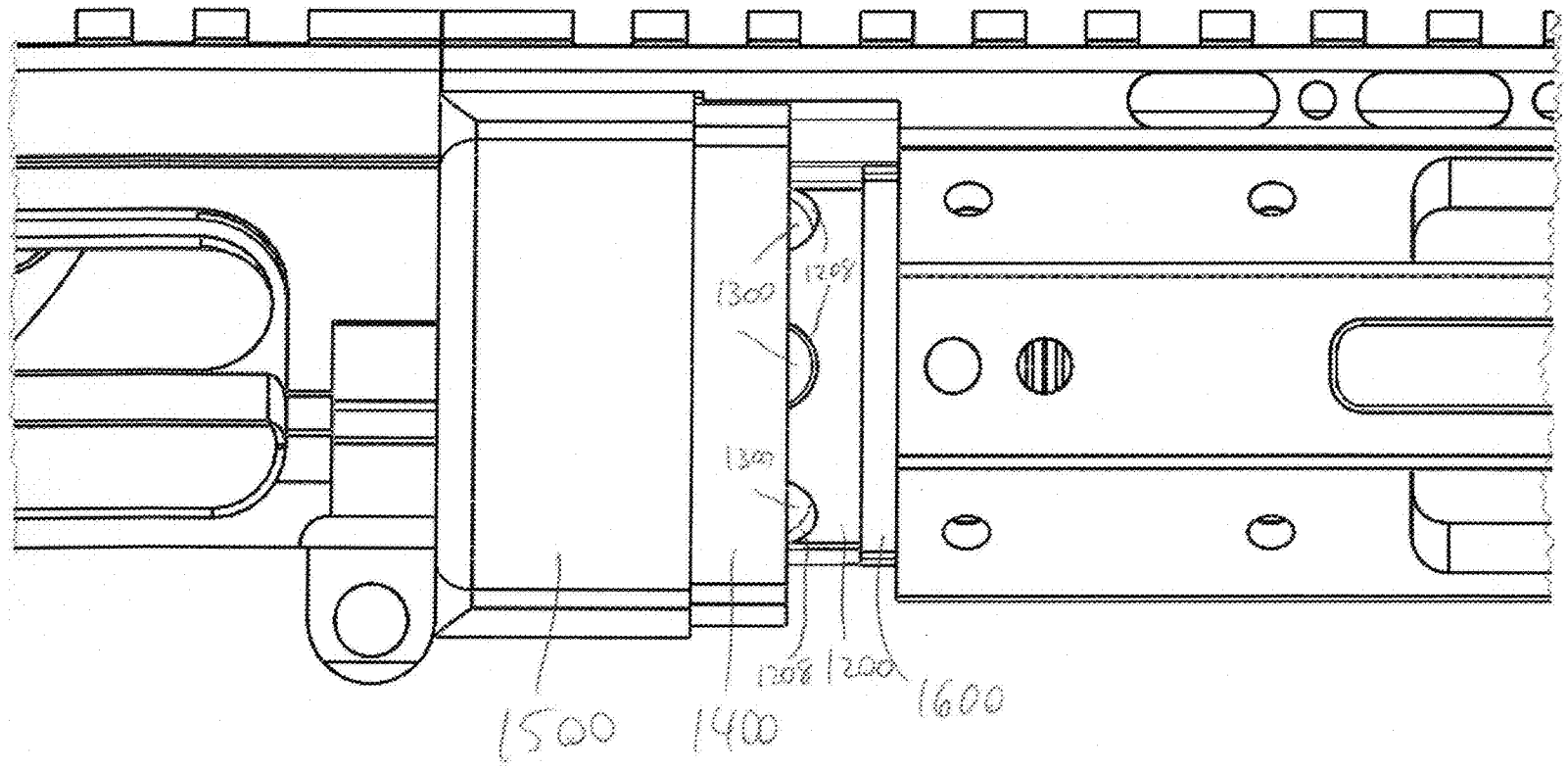
FIG. 29 is a side plan view of the barrel and handguard of FIG. 20 with the barrel completely inserted into the coupling mechanism and the dust cover completely retracted.
Figure 30:
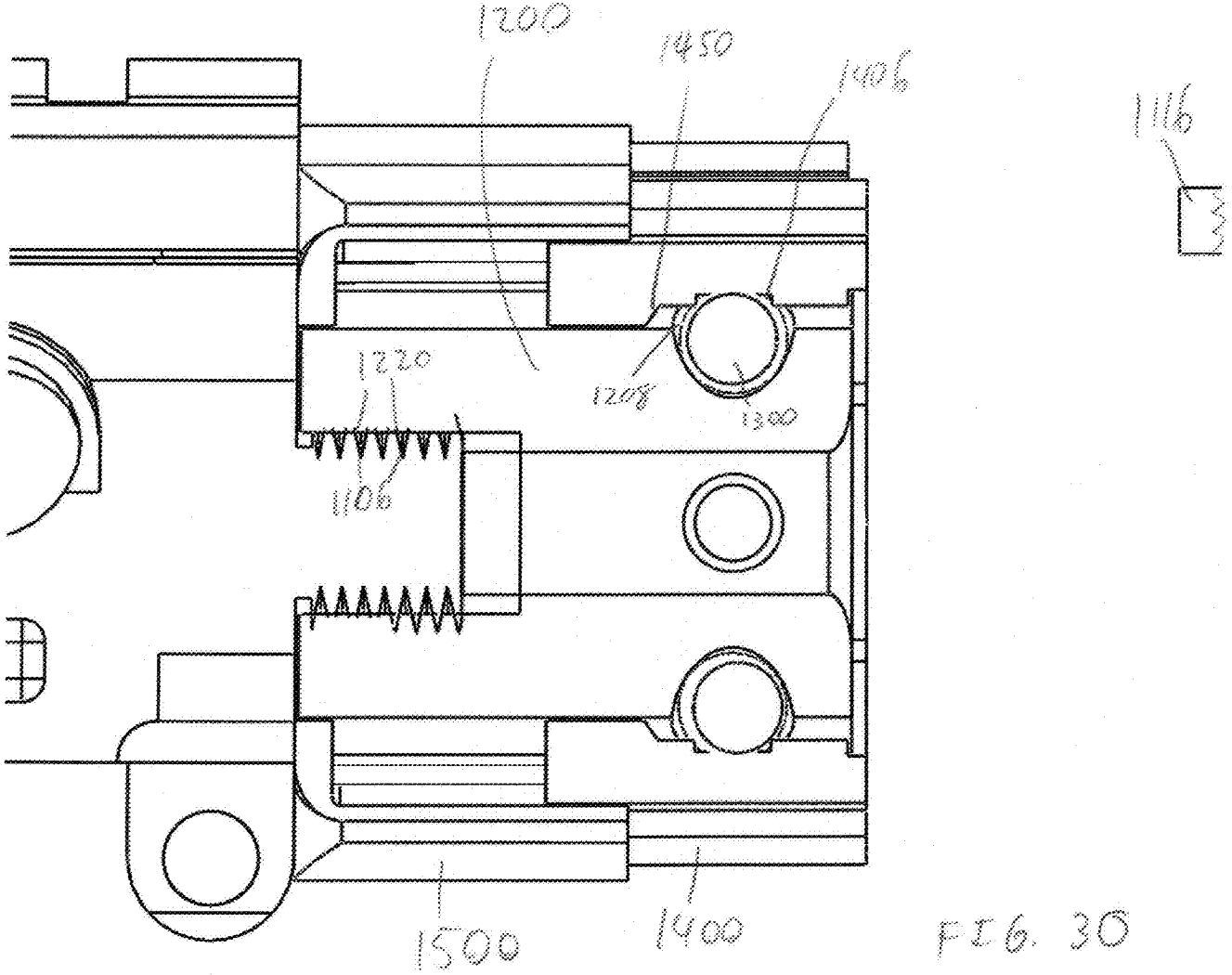
FIG. 30 is a side cut-away view of the coupling mechanism attached to the upper receiver with ball bearings in a first position.
Figure 31:
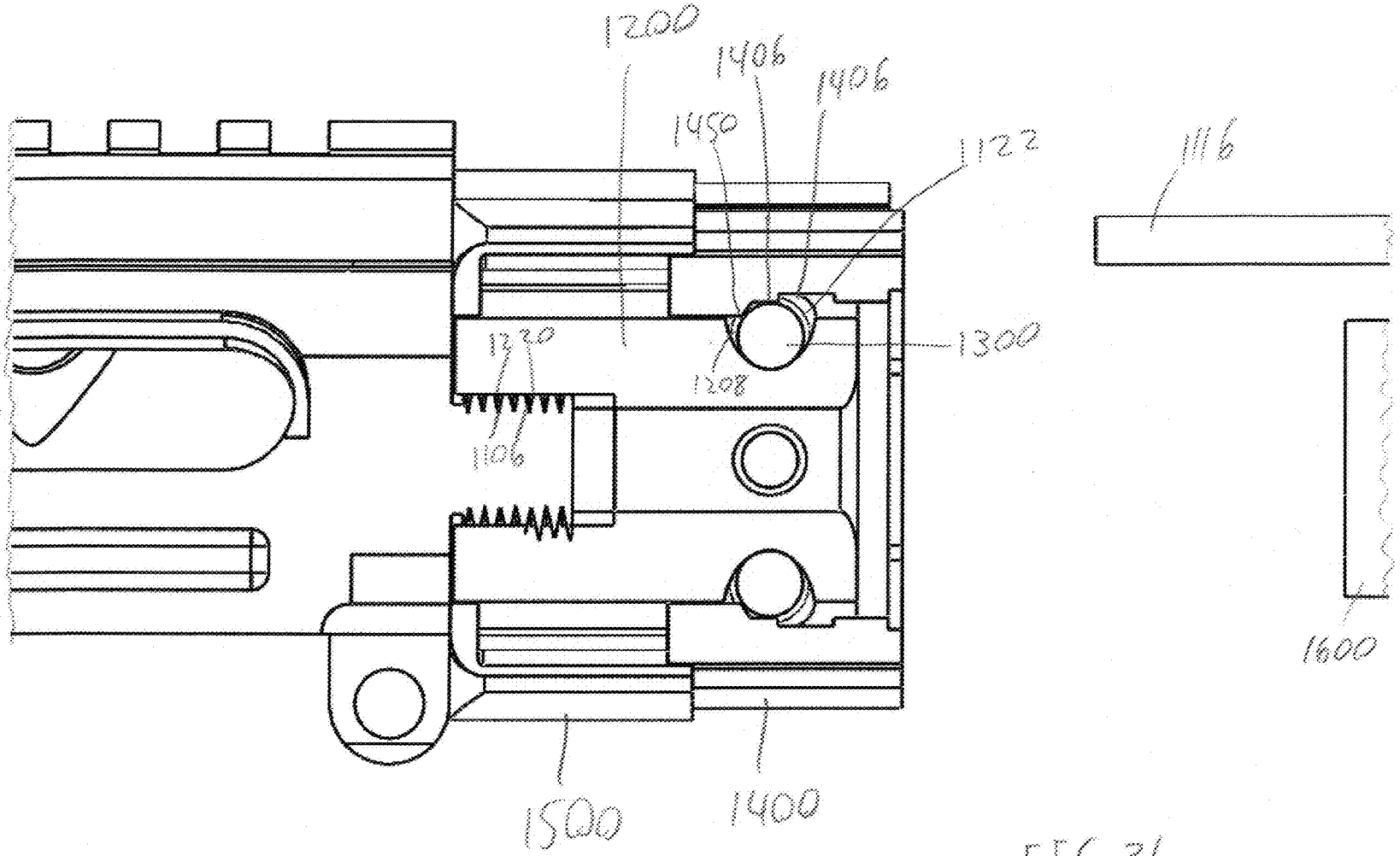
FIG. 31 is a side cut-away view of the coupling mechanism with ball bearings in a second position.

As shown in FIGS. 6-9 and 13-14, the ball bearing case 1200 includes a plurality of slots or reliefs 1208 for each housing a ball bearing 1300. The ball bearings 1300 are further secured within and on the ball bearing case 1200, respectively, by a spring sleeve 1400, which circumscribes the ball bearing case 1200 and is engaged with the biasing member. The spring sleeve 1400 is self-secured onto the ball bearing case 1200 by virtue of limited clearance between the spring sleeve inner end 1410 and the upper receiver 1102, and limited clearance between the spring sleeve outer end 1412 and the ball bearings 1300, as shown in FIGS. 13, 18, and 30-32. Notches 1406, shown in FIGS. 10-11, are formed an interior surface 1408 of the outer end 1402 of the spring sleeve 1400 for receiving a portion of each of the ball bearings 1300 when the barrel sleeve 1108 and then a first intermediate portion 1110 of the barrel 1104 is first inserted into the ball bearing case 1200, as shown in FIG. 22. As the barrel 1104 is further inserted into the ball bearing case 1200 and the upper receiver 1102, as shown in FIG. 23, a second intermediate portion 1112 of the barrel 1104 reaches the position of the ball bearings 1300, such that grooves 1122 in the second intermediate portion 1112 of the barrel 1104, as shown in FIGS. 24 and 32, engage the ball bearings 1300. The barrel sleeve 1108 is fixedly coupled on one end to an end of a barrel 1104 of the firearm 1000, as shown for example in FIGS. 21-25 and 32. The barrel sleeve 1108 is engaged with the ball bearing case 1200 on an opposite end when the coupling mechanism 1110, described herein, is in use.

Figure 6:
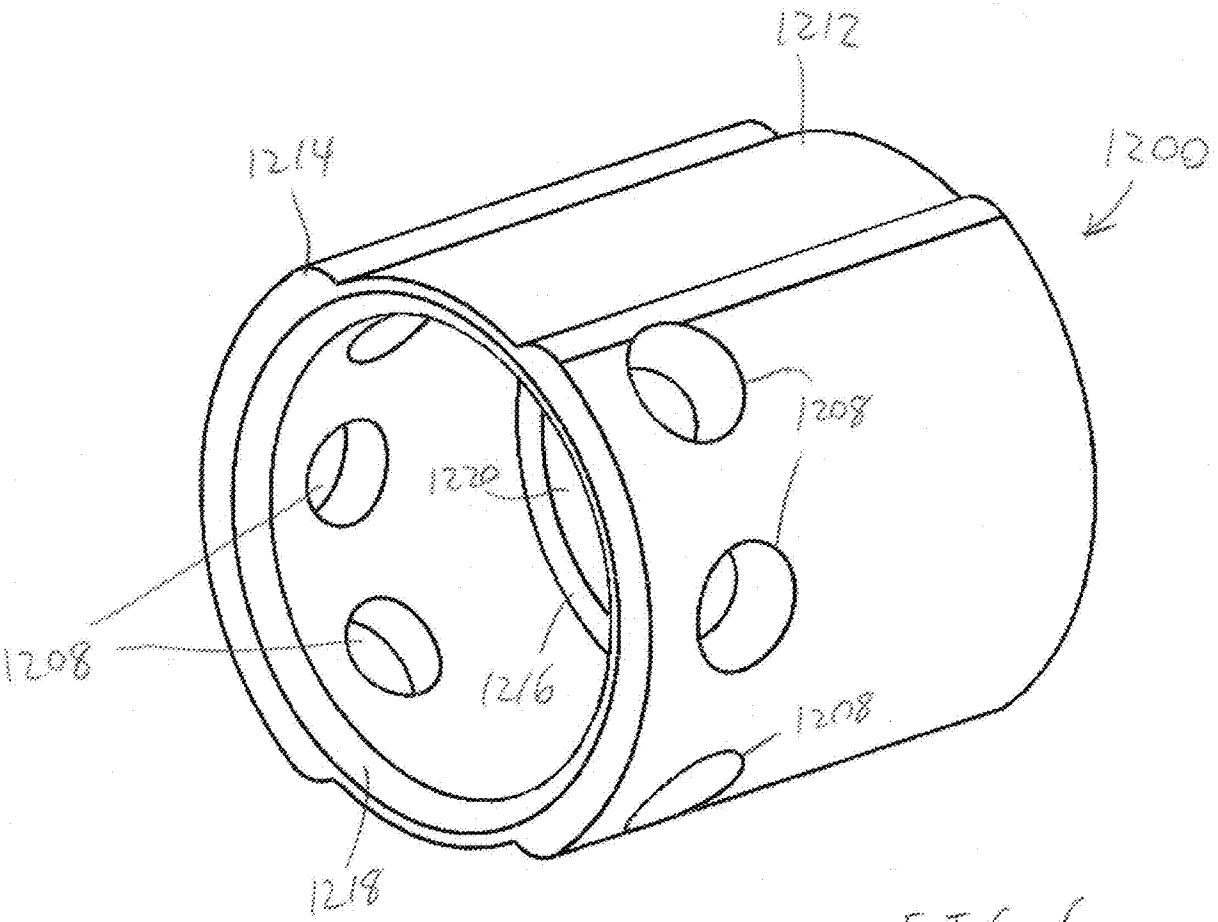
FIG. 6 is a top front side perspective view of the bearing case.
Figure 7:
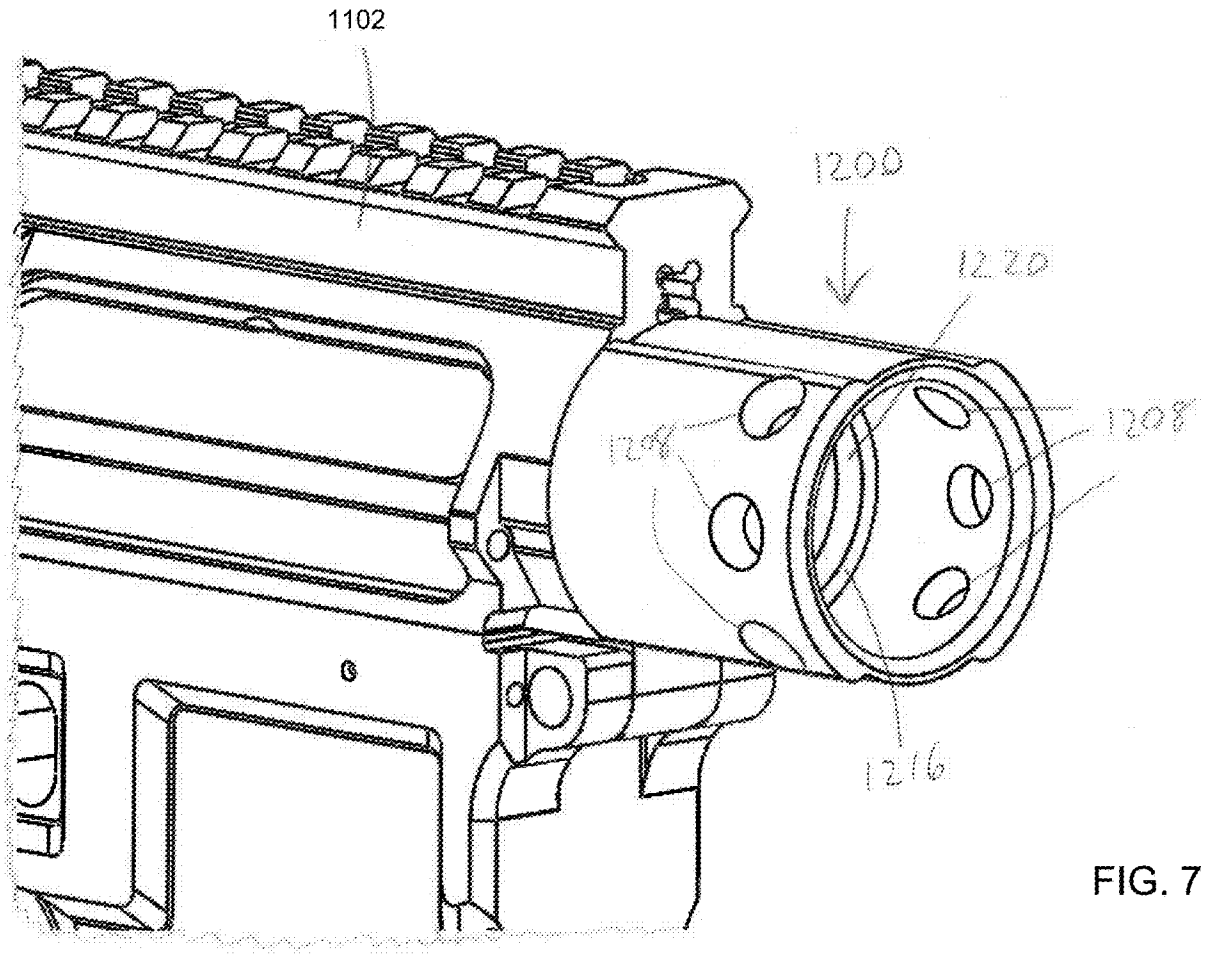
FIG. 7 is a top front side perspective view of the bearing case of FIG. 6 mounted to an upper receiver.
Figure 8:
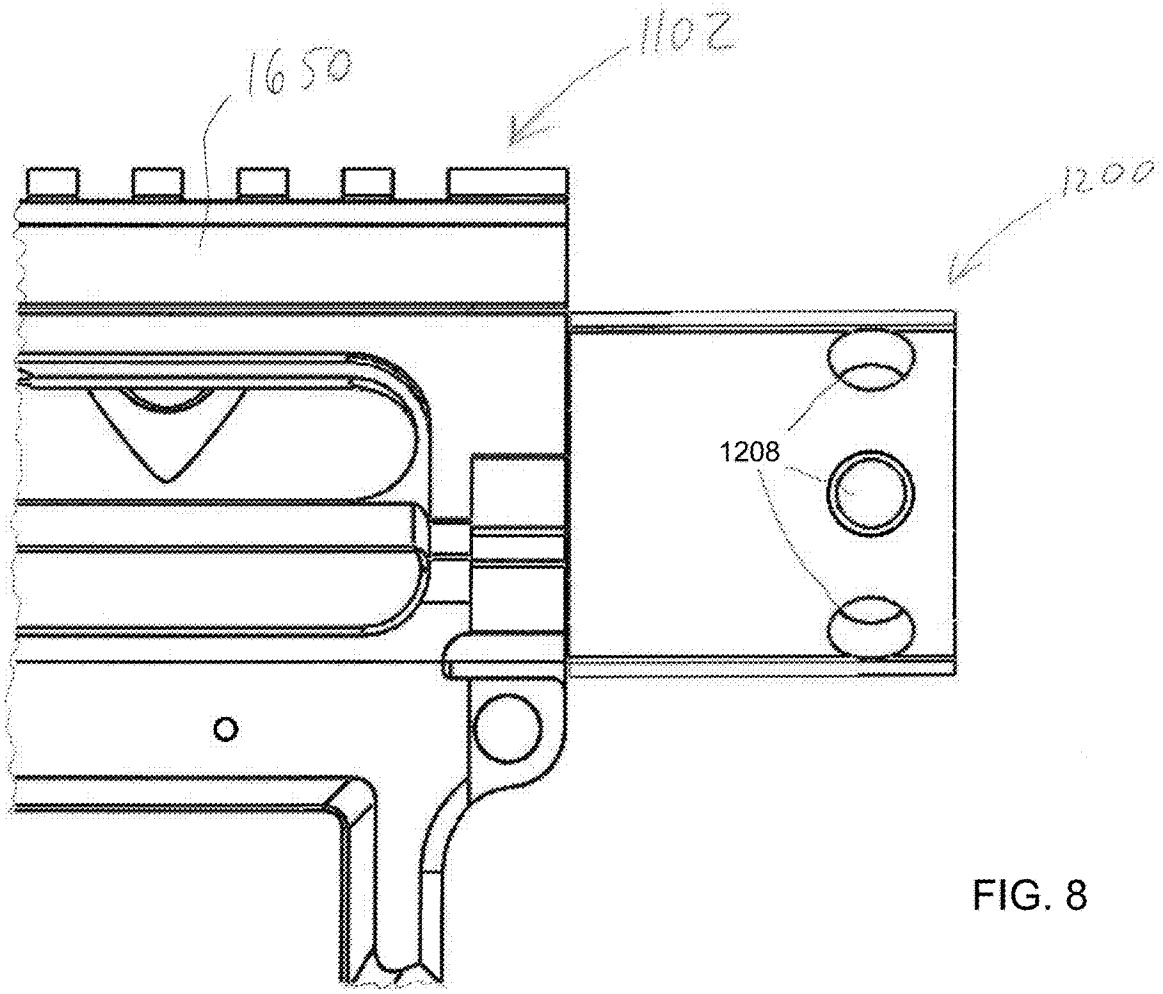
FIG. 8 is a side plan view of the bearing case of FIG. 7.
Figure 9:
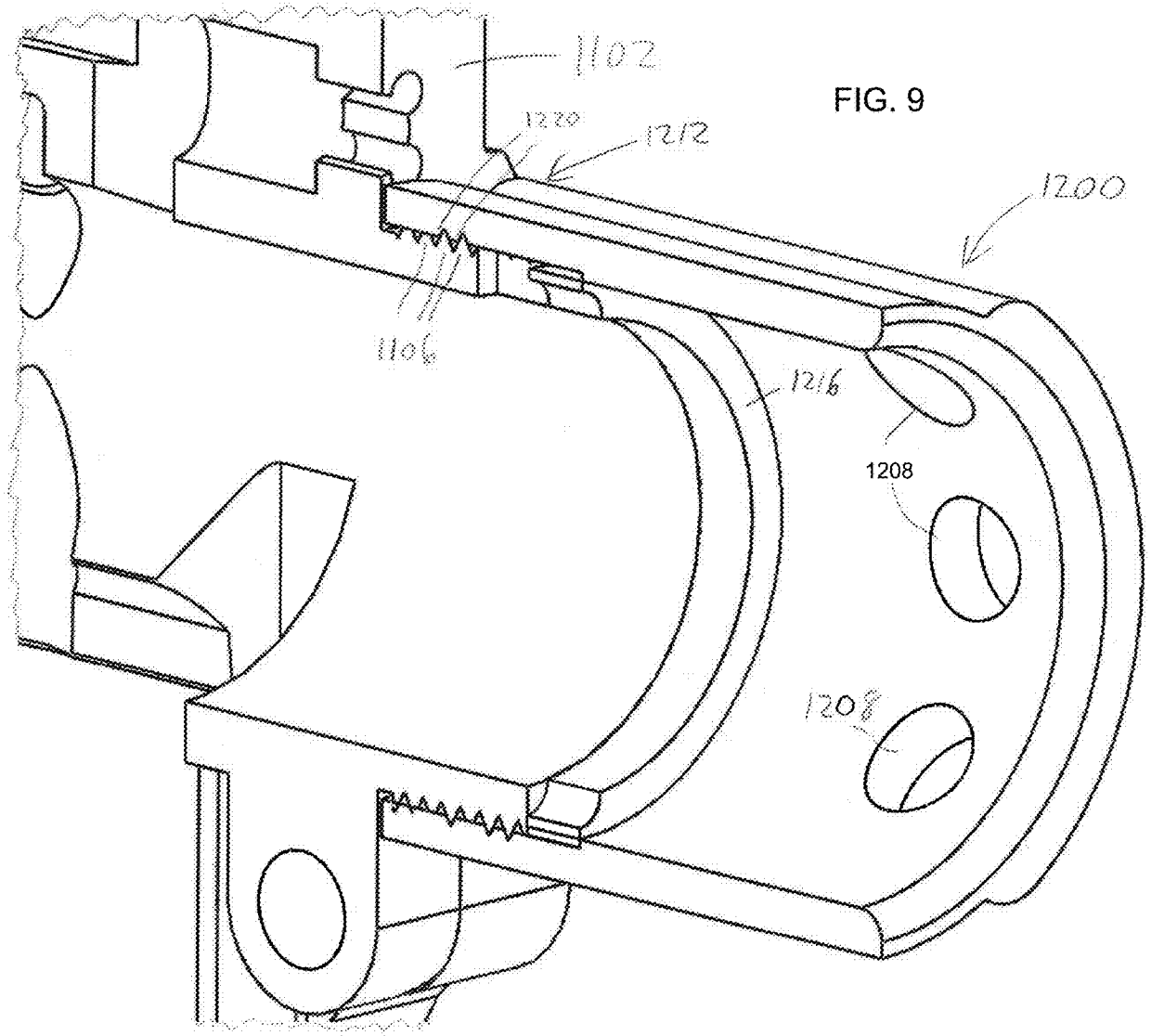
FIG. 9 is a top front side cut-away perspective view of the bearing case of FIG. 7.
Figure 14:
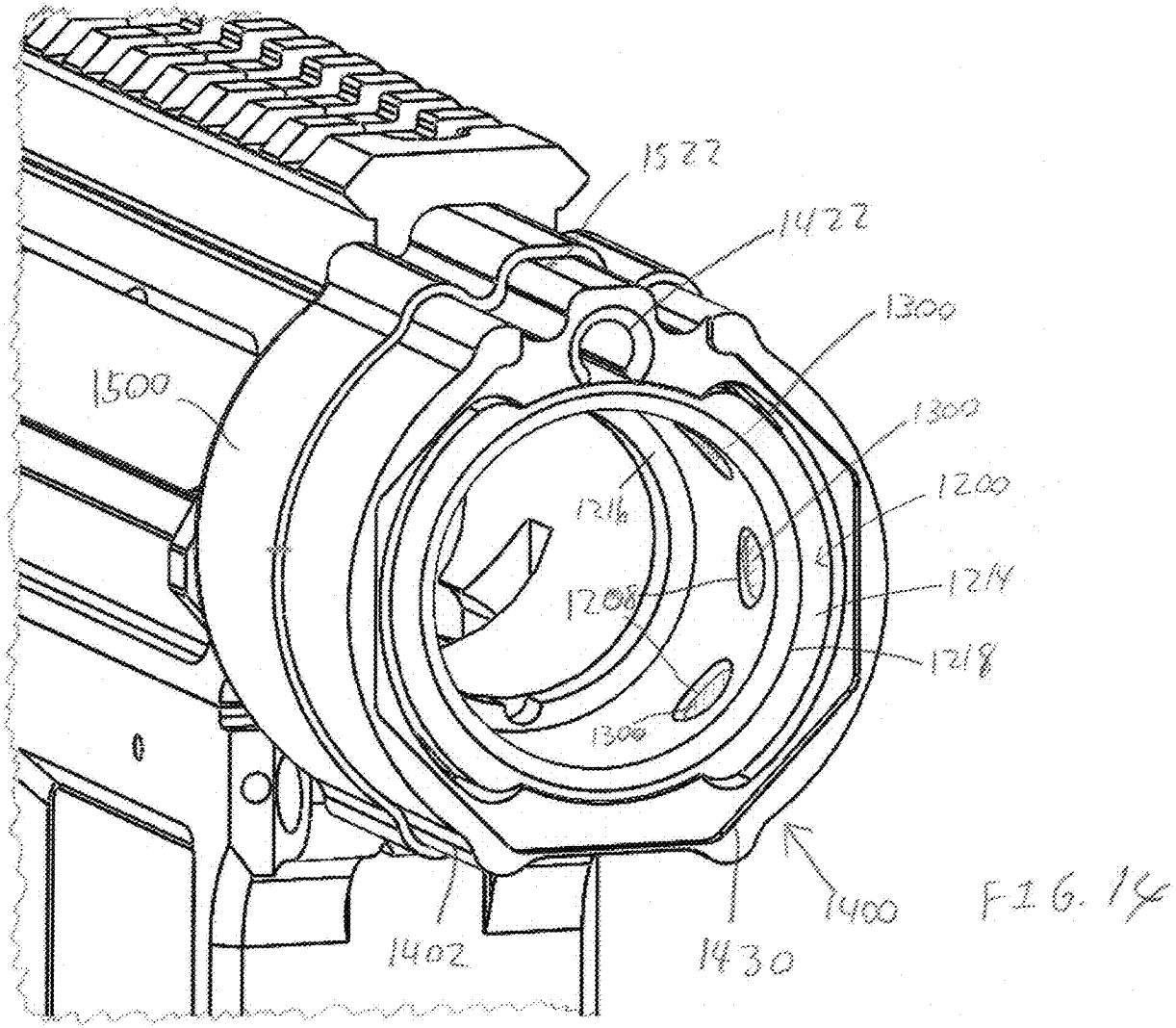
FIG. 14 is a top front side perspective view of the coupling mechanism.
Figure 15:
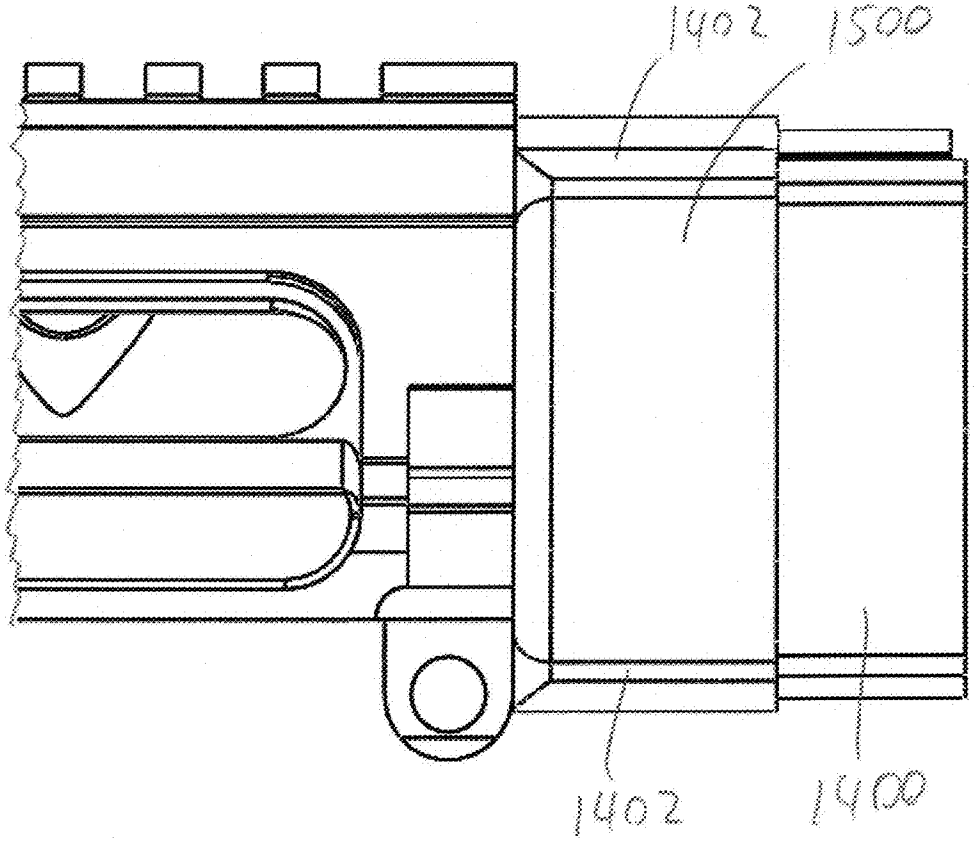
FIG. 15 is a side plan view of the coupling mechanism of FIG. 14.

Referring to FIGS. 9 and 14, the ball bearing case 1200 includes an upper member 1212 and a lower member 1214 integrally formed with each other, with each member 1212, 1214 being substantially cylindrical. The inner diameter of the lower member 1214 is greater than the inner diameter of the upper member 1212 such that a substantially planar upper surface or inner lip 1216 is formed on the lower member 1214 circumscribing a lower end of the upper member 1212, as shown in FIG. 6, such that an upper surface of the inner lip 1216 butts up against the upper receiver 1102, as shown in FIG. 9. As further shown in FIGS. 6 and 9, a lower end of the lower member 1214 has an inside lip 1218 which is rounded to ease insertion of the barrel 1104, and an gap 1120 of the barrel 1104, shown in FIG. 32, butts up against a lower surface of the inner lip 1216.

Referring to FIGS. 6, 13, and 30-32, an inner diameter surface of the upper member 1212 of the ball bearing case 1200 includes threads 1220, which match the threads 1106 of an upper receiver 1102 of a firearm 1100. In this embodiment, the threads are 2B thread in order to allow for compatibility with various manufacturers of upper receivers and in consideration of threaded mating of aluminum or steel. The standard length of the threaded portion of the upper receiver is 0.445 inches. In this embodiment, the threaded portion 1220 of the inner diameter surface is 0.4 inches to allow for many index positions against the upper receiver 1102, thus allowing for differences in manufacturing tolerances between different upper receivers. Also, shorter threading on the inner diameter surface ensures that the entire threaded portion on the inner diameter surface of the ball bearing case 1200 is engaged with the upper receiver 1102 so that the barrel sleeve 1108, when engaged with the ball bearing case 1200, does not make contact with any threads.

Referring to FIGS. 6-9, the lower member 1214 includes a plurality of slots 1208 disposed on side portions thereof. Each slot 1208 is tapered and extends through an outer edge of the lower member 1214 forming a relief cut on the outer edge. The relief cuts are utilized to install the ball bearings 1300, which will be described in more detail below. Each slot 1208 is configured to house a ball bearing 1300 and includes an aperture in which each ball bearing 1300 extends partially therethrough. As shown in FIGS. 10-11, 18, and 30-31, a 45 degree chamfer or bevel applies downward pressure on the bearings 1300, and circular cuts or notches 1406 are made into the inside of the spring sleeve 1400 to give the bearings 1300 the proper amount of outward travel to allow the coupling to disengage the barrel 1104.

As shown in FIGS. 6-9 and 13, the ball bearing case 1200 includes a plurality of apertures 1208, the centers of which are substantially aligned radially along the circumference of the ball bearing case 1200. As shown in FIGS. 10-11, 18, and 30-31, a 45 degree chamfer in the circular notches or cuts 1406 of the spring sleeve 1400 applies radial pressure on the ball bearings 1300 towards the longitudinal axis of the spring sleeve 1400. The circular notches or cuts 1406 are fabricated into the inside surface of the spring sleeve 1400 to give the ball bearings 1300 a proper amount of radially outward travel to allow the coupling mechanism 1110 to disengage the barrel 1104 when the user pulls the spring sleeve 1400 backward and toward the upper receiver 1102.

As shown in FIGS. 10-14, apertures 1422, 1522 in the spring sleeve 1400 and the dust cover 1500, respectively, accommodate a gas tube 1116, a shown in FIGS. 2-4 and 19-23, which extends from the barrel 1104. As shown in FIG. 14, the exterior opening of the aperture 1422 is chamfered to aid insertion of the gas tube 1116.

Referring now to FIG. 10-11, the spring sleeve 1400 of the present invention is shown. The spring sleeve 1400 is configured to circumscribe the ball bearing case 1200 and to secure the ball bearings 1300 on the ball bearing case 1200, as shown in FIG. 14. The spring sleeve 400 is generally cylindrical and includes an upper end 1410 and a lower end 1412 integrally formed together, with the inner diameter of the upper end 1410 being less than the inner diameter of the lower end 1412. The lower end 1412, with the notches 1406, is constructed with tolerances for the spring sleeve 1400 to be slidingly engaged with the ball bearing 1300 while providing sufficient friction to remain engaged when the coupling mechanism is engaged and the firearm 1100 is in use. With such tolerances, sheering of the slots 1208 of the ball bearing case 1200 is prevented and any cracking of the spring sleeve 1400 is avoided as well. The notches or chamfers 1406 allows the spring sleeve 1400 to engage the ball bearings 1300 with sufficient force inwards toward the bore of the barrel 1104, creating a solid lock while ensuring that the barrel 1104 of the firearm 1100 is concentric and aligned with the upper receiver 1102. The notches or chamfers 1406 of the outer end 1412 also aids in reducing wear on the coupling mechanism 1110 by eliminating vibration. Lastly, the notches or chamfers 1406 serves to retain the spring sleeve 1400 on the coupling mechanism 1110 during installation of the coupling mechanism 1110. That is, the notches or chamfers 1406 provides a mechanism for remaining engaged with the ball bearing 1300 and within the coupling mechanism 1100 without disengaging from the coupling mechanism 1110 due to the force from the biasing member. Also, as described in more detail below, the notches or chambers 1406 also provides a retaining means for the spring sleeve 1400 after assembly of the coupling mechanism 1110 such that the spring sleeve 1400 is independently retained on the coupling mechanism 1110 without other components securing the same.

Figure 16:
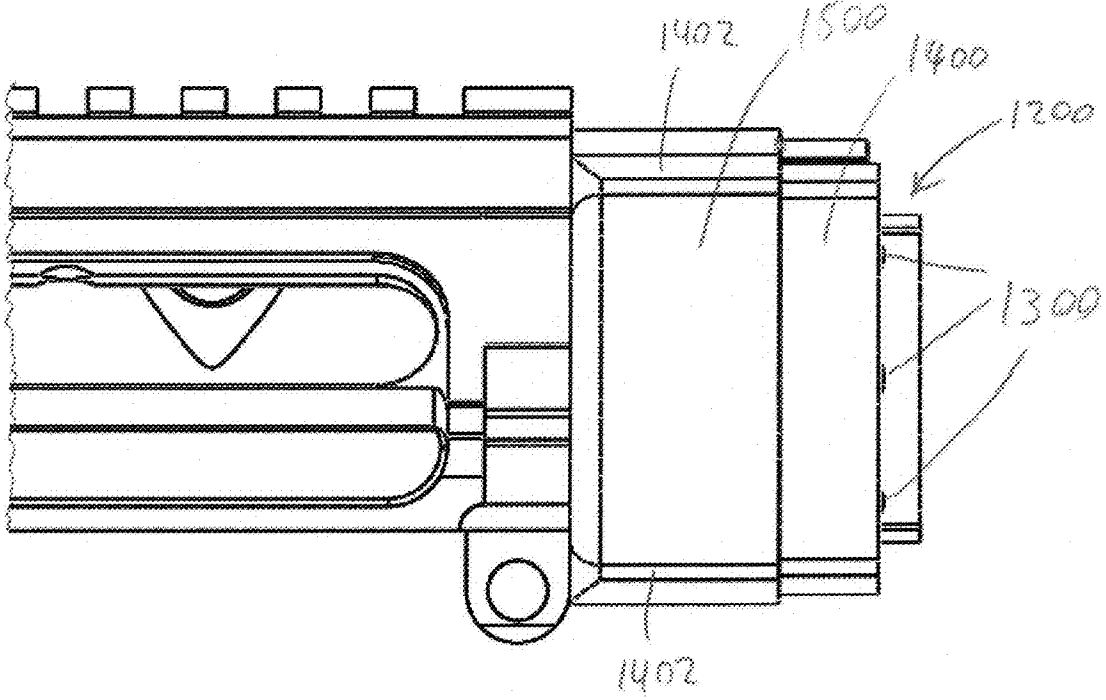
FIG. 16 is a side plan view of the coupling mechanism of FIG. 14 with the dust cover partially retracted.
Figure 17:
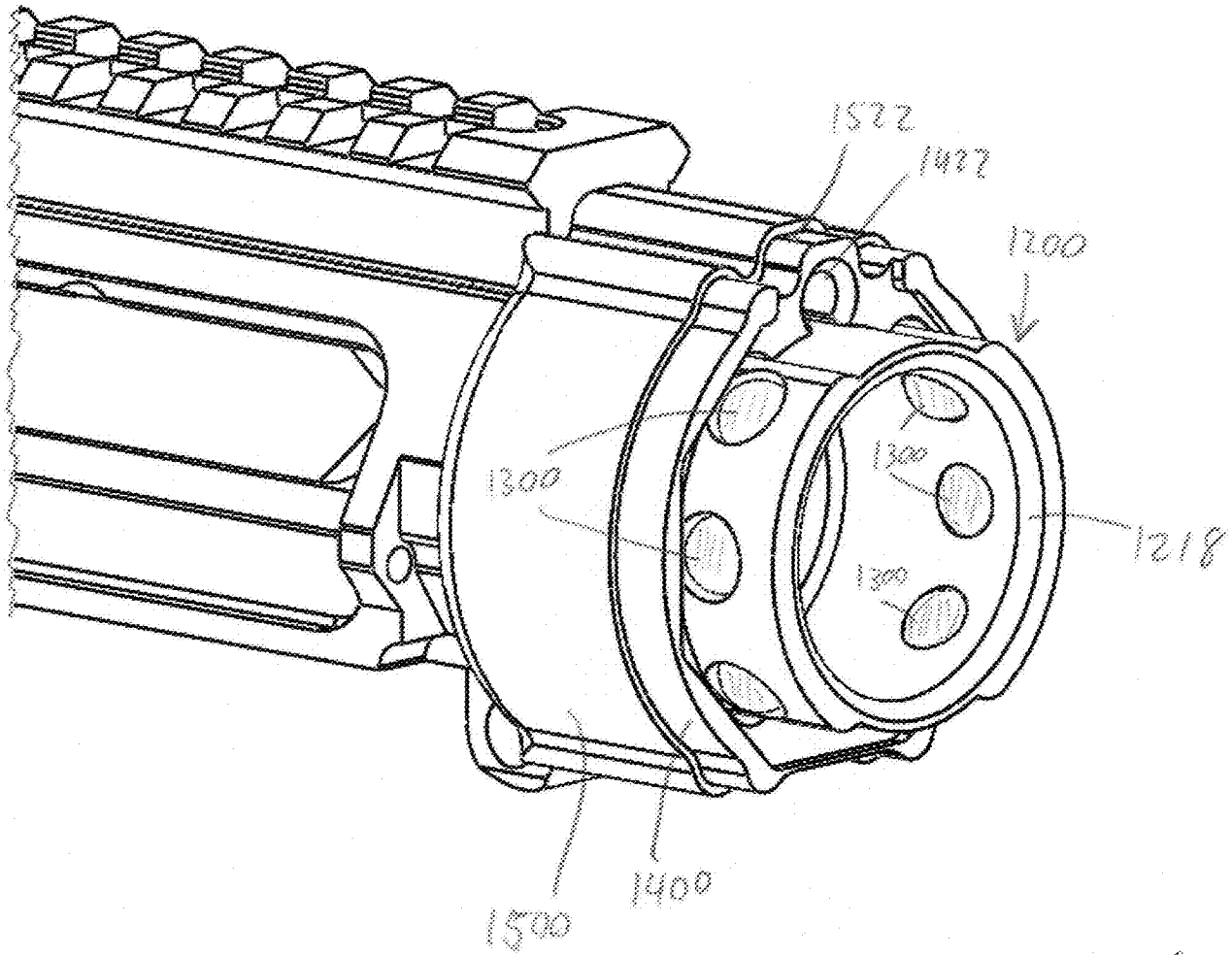
FIG. 17 is a top front side perspective view of the coupling mechanism of FIG. 14 with the dust cover completely retracted.
Figure 18:
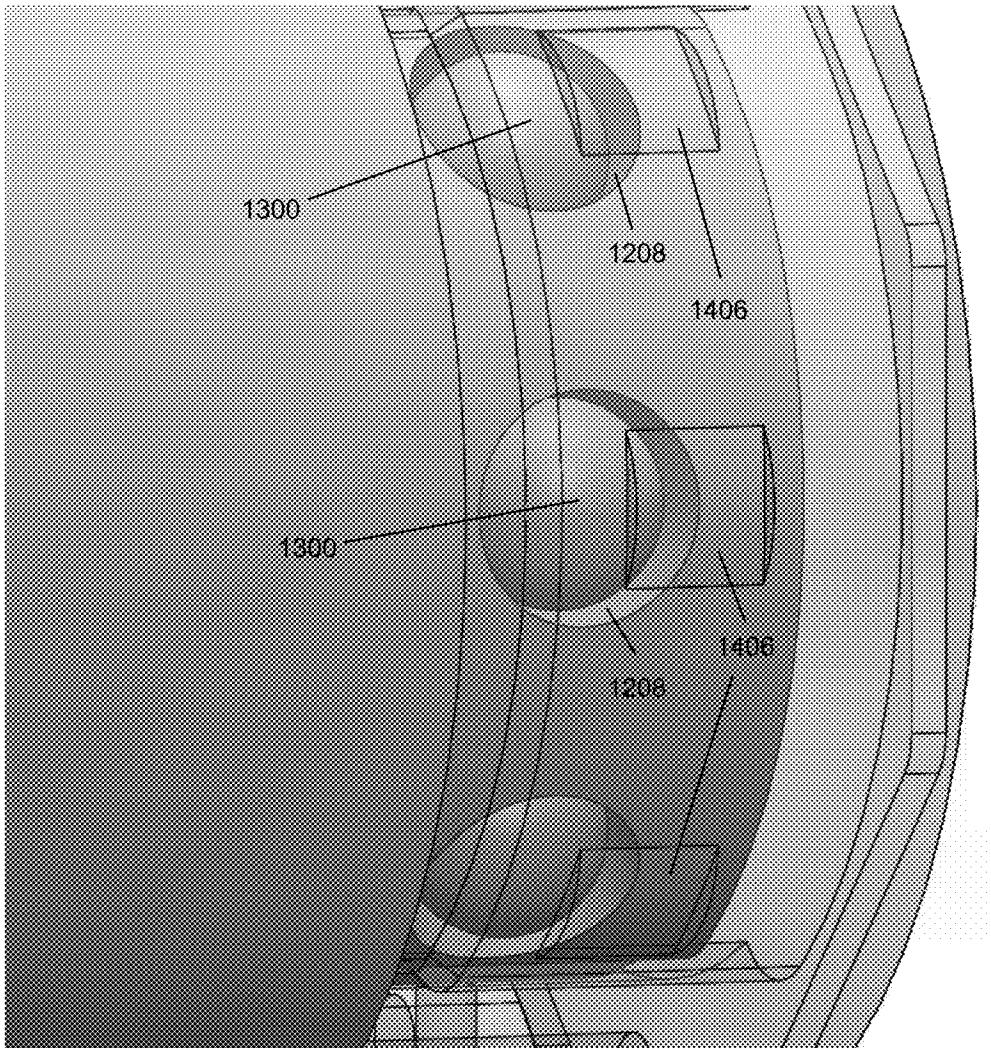
FIG. 18 is a top front side perspective view of a ball bearing in a chamfered slot.
Figure 19:
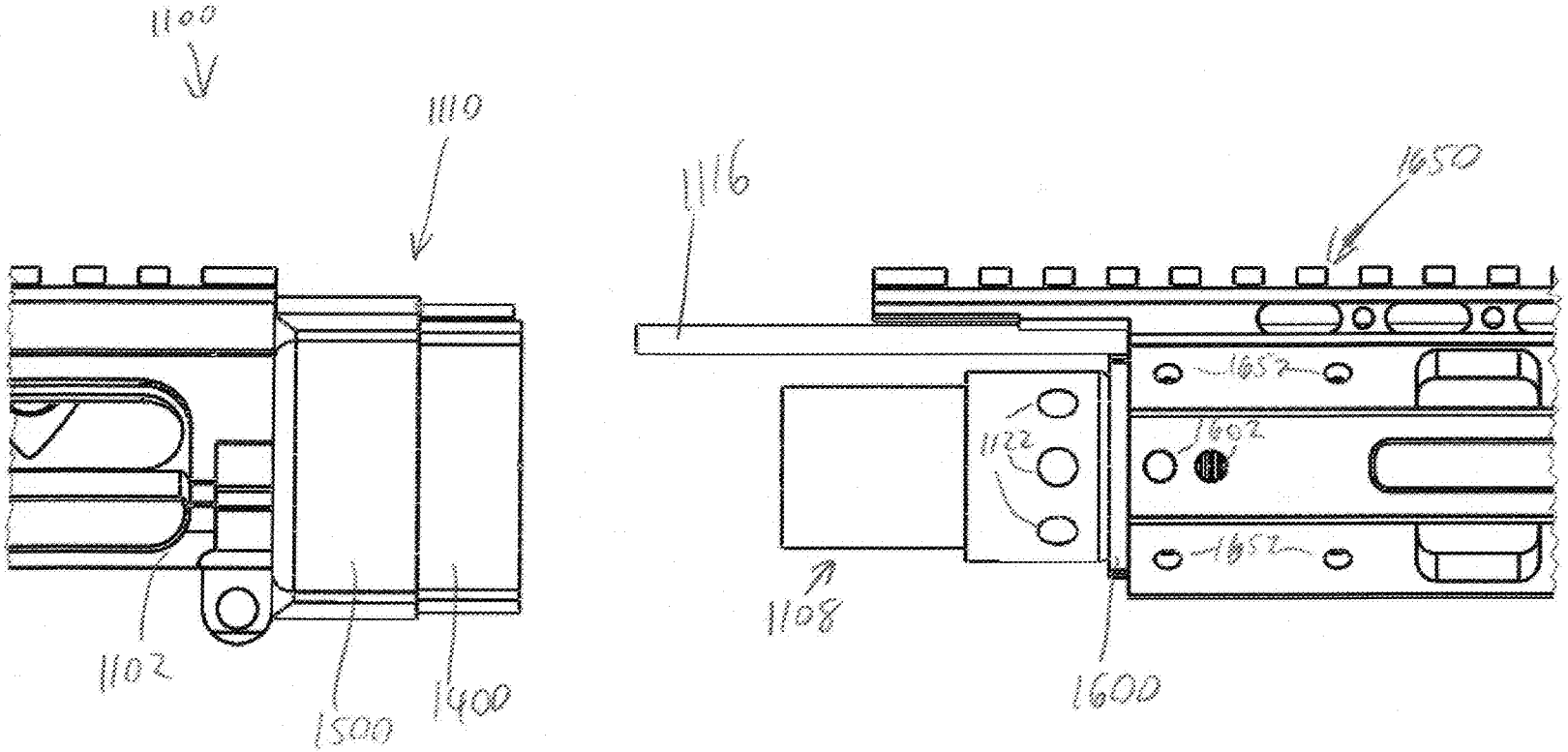
FIG. 19 is a side plan view of the firearm with the barrel and handguard separated from the upper receiver and the coupling mechanism.
Figure 20:
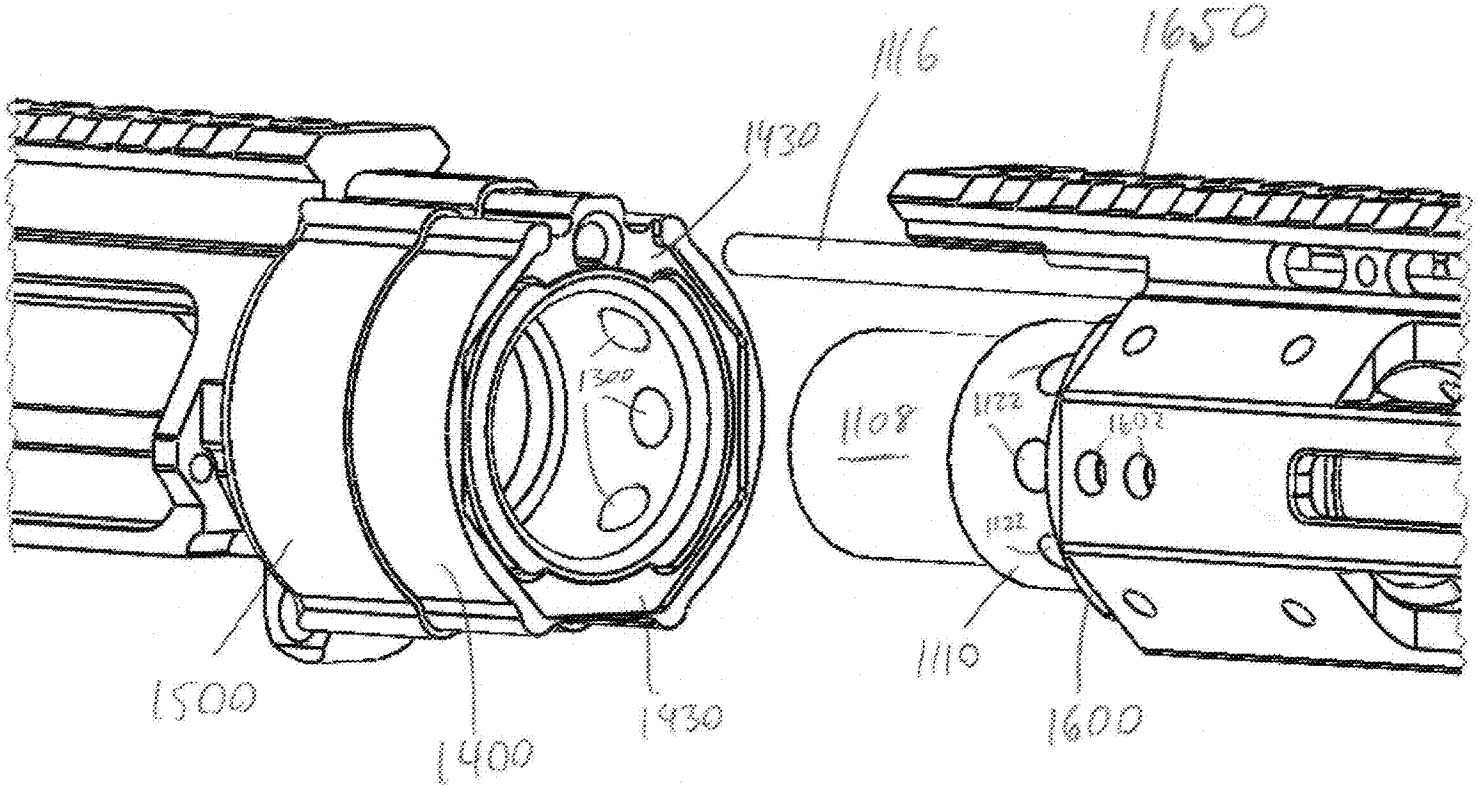
FIG. 20 is a top front side perspective view of the firearm with the barrel and handguard separated from the upper receiver and the coupling mechanism.
Figure 21:
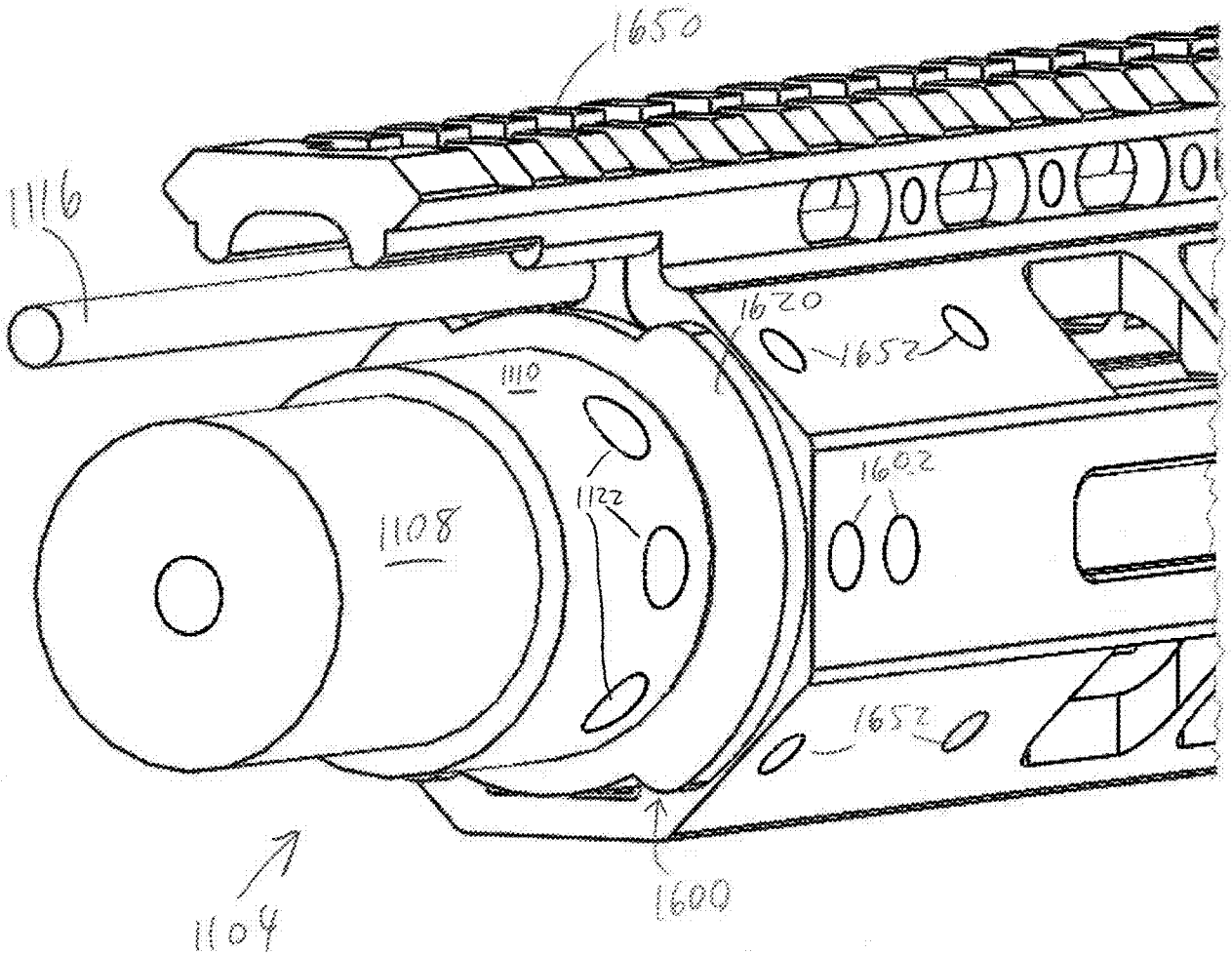
FIG. 21 is a top rear side perspective view of the barrel and the handguard.

In this configuration, while the spring sleeve 1400 is moved toward or away from the upper receiver 1102 by the gripping and pulling of the spring sleeve 1400 by the user, as shown in FIGS. 16-17, the dust cover 1500 continues to cover the upper end 1412 of the spring sleeve 1400 during engagement or disengagement of the barrel 1104 from the upper receiver 1102, thus preventing dust and debris from entering the coupling mechanism 1110.

Referring to FIGS. 13-14, a ball bearing 1300 of the present invention is shown. The ball bearing 1300 is sized in accordance with the size of the slots 1208 of the ball bearing case 1200, the grooves 1406 of the spring sleeve 1400, and the grooves 1122 of the barrel 1104, as shown in FIGS. 13-14, 10-11, and 18-25, respectively. The grooves 1122 are fabricated on the immediate portion 1112 of the barrel 1104 by dimpling.

The coupling mechanism 1110 is installed on a firearm 1100 by attaching the ball bearing case 1200 to the upper receiver 1102 of the firearm 1100, and the barrel 1104 is then attached to the ball bearing case 1200 by insertion of the barrel 1104 into the ball bearing case 1200 until the ball bearings 1300 engage and secure the grooves 1122, as in FIGS. 19-26.

The ball bearing case 1200 is coupled to the upper receiver 1102 by threaded engagement. Initially, the internal threads 1220 of the ball bearing case 1200 are only partially threaded onto the threads 1106 of the upper receiver 1102. Then the spring sleeve 1400 is positioned above the biasing member 1200. Because the ball bearing case 1200 is only partially secured to the upper receiver 1102, additional clearance is formed between the spring sleeve and the upper receiver 1102. The spring sleeve 1400 is engaged or retracted toward the upper receiver 1102 by compressing the biasing member. Due to the additional clearance formed by only partially securing the ball bearing case 1200 to the upper receiver 1102, the spring sleeve 1400 is extended at least partially beyond the relief cuts formed by the tapered holes 1208 of the ball bearing case 1200, providing sufficient clearance between the same such that the clearance distance exceeds the diameter of the ball bearing 1300. While in this position, each ball bearing 1300 is inserted and positioned within corresponding slots 1208. Once the ball bearings 1300 are properly positioned, the spring sleeve 1400 is disengaged and the biasing member is extended, thus, the ball bearings 1300 are engaged and secured between the spring sleeve 1400 and ball bearing case 1200.

The ball bearing case 1200 is then further threaded onto the upper receiver 1102 and completely coupled to the upper receiver 1102 such that the apertures 1422, 1522 are aligned with the gas tube 1116, which normally extends from a top portion of the barrel 1104. An adhesive or sealant (generally referred to as a threadlocker), such as LOCTITE, could be applied to the threaded engagement.

Referring to FIGS. 2-4 and 19-32, in operation, after installation of the components as described above, the firearm barrel 1104 is coupled to the upper receiver 1102 of the firearm 1100 by connecting the barrel 1104 to the ball bearing case 1200. Specifically, the spring sleeve 1400 is retracted while the barrel 1104 is inserted into the ball bearing case 1100, as shown in FIGS. 16-17 and 22-32. In this position, the ball bearings 1300 are displaced outward while the grooves 1122 on the barrel 1104 engage the displaced ball bearings 1300. However, now due to the ball bearing case 1200 having been completely threaded onto and secured to the upper receiver 1102, the clearance formed between the spring sleeve 1400 is less than the diameter of the ball bearings 1300. Thus, the ball bearings 1300 are displaced from the slots 1208 but still secured between the spring sleeve 1400 and the ball bearing case 1200. The gas tube 1116 extending from the barrel 1104 is inserted into corresponding 1422, 1522 of the spring sleeve 1400 and the dust cover 1500, respectively. The barrel 1104 is positioned within the ball bearing case 1200 such that the grooves 1122 are radially aligned with the ball bearings 1300 and the slots 1208. The spring sleeve 1400 is disengaged and the coupling mechanism 1110 is secured into a fully assembled firearm. The steps described above are reversed to disassemble the firearm 1100. The presence of the various features of the coupling mechanism 1100, namely for example, the notches 1406 of the spring sleeve 1400 and the relief cuts formed by the holes 1208 of the bearing case 1200, provides for a smooth, effortless assembly and disassembly of the coupling mechanism 1100.

In another embodiment, shown in FIGS. 2-3 and 19-25, a handguard adaptor 1600 is used to mount a handguard 1650 to the firearm 1100. As shown in FIGS. 1-3 and 29, the handguard adaptor 1600 is first attached to the barrel 1104 by at least one set screw extending through at least one aperture 1602, by which the at least one set screw can engage a rib or groove 1146 of the barrel 1104, as shown in FIGS. 4 and 32. An adhesive or sealant, such as LOCTITE, could be applied to the set screw engagements prior to engagement. Referring to FIG. 4, the intermediate portion 1112 of the barrel 1104 has, on its exterior surface, at least one flat portion 1126 which allows for a set screw to index the handguard adaptor 1600 at the 12 o'clock or the 6 o'clock positions. As shown in FIGS. 1-3 and 29, holes 1602 extend through the handguard 1650 to receive set screws to fix the handguard adaptor 1600 to the flat portion 1126 of the barrel 1104. In addition, the handguard 1650 is shaped to provide a relief 1660 to clear the top of the dust cover 1500, and shaped to provide another relief 1662 to clear the top of the spring sleeve 1400, as shown in FIG. 5.

Figure 2:
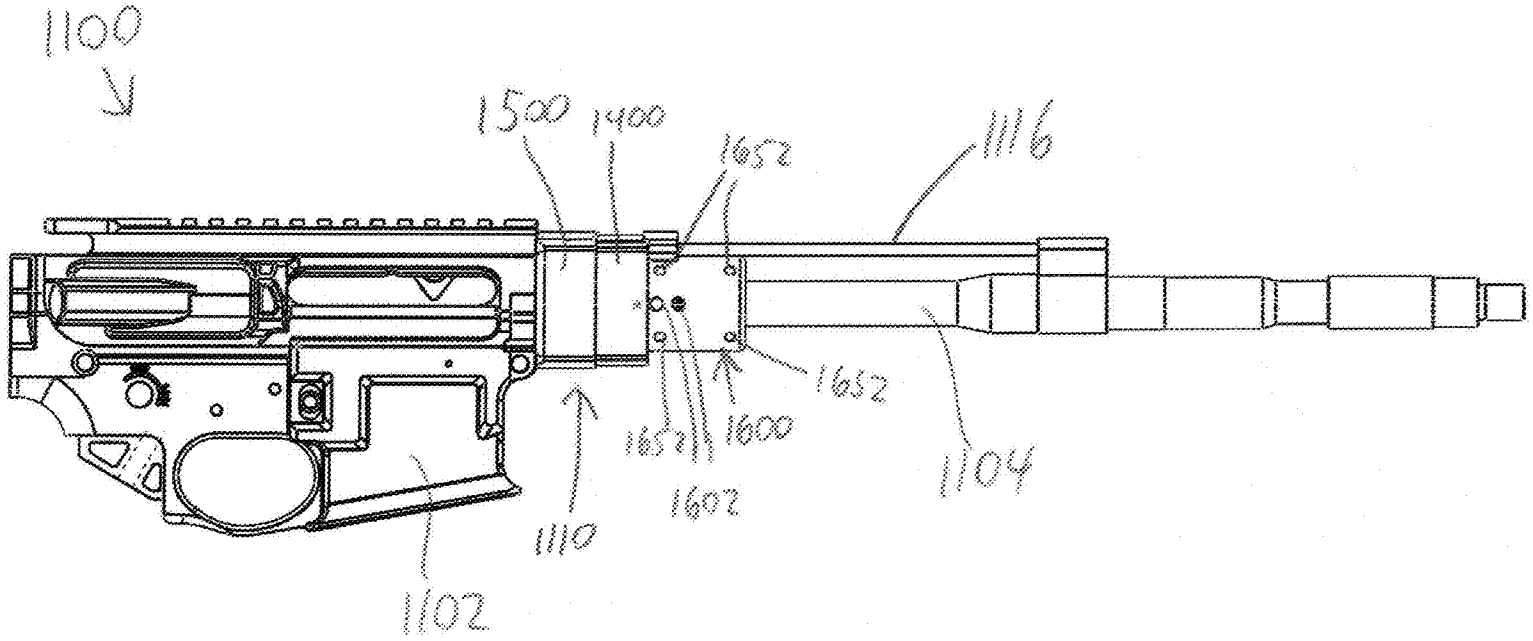
FIG. 2 is a side plan view of the firearm of FIG. 1 without a handguard.
Figure 5:
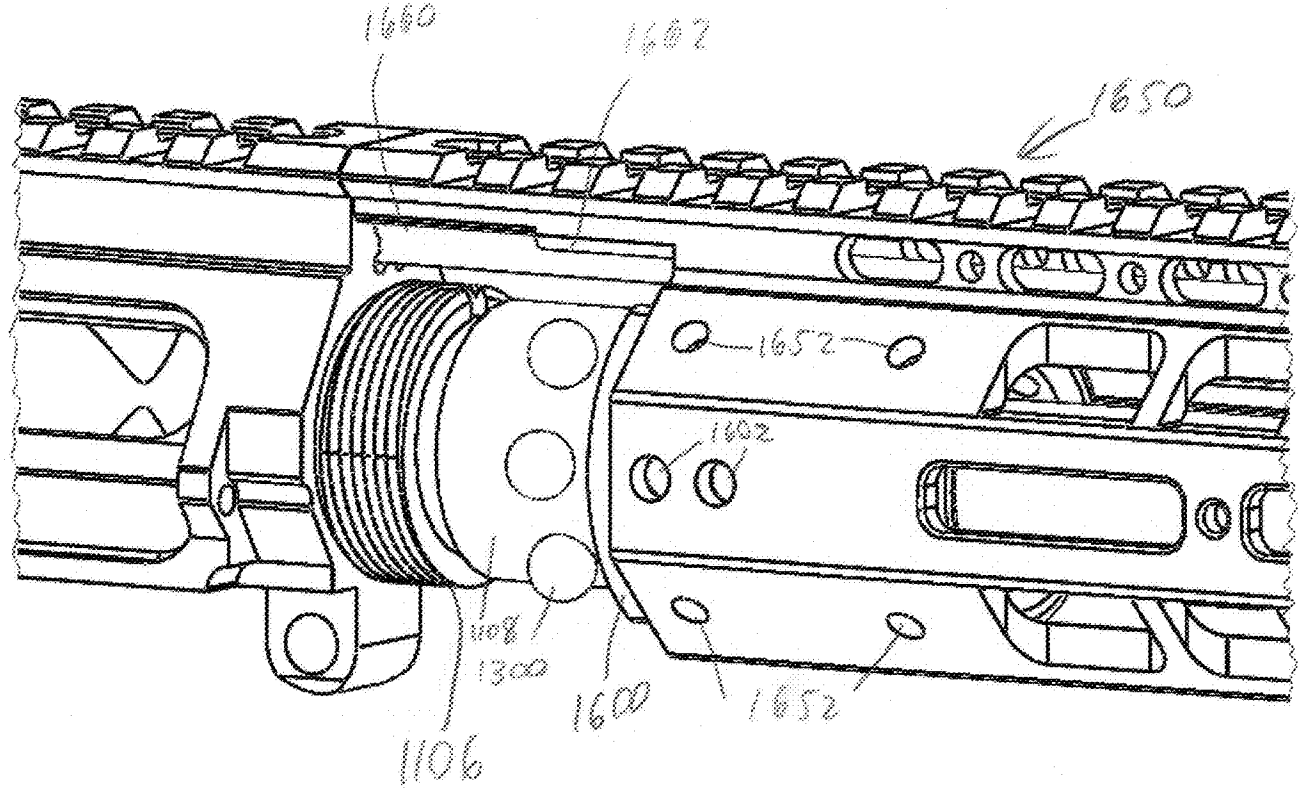
FIG. 5 is a top front side perspective view of the firearm with the handguard and without the coupling mechanism.

The handguard 1650 is then mounted to the handguard adaptor 1600 by at least one set screw extending through at least one aperture 1652, as shown in FIG. 5. As shown in FIGS. 10-11, 14, and 20, the lower end of the spring sleeve 1400 has a plurality of lips 1430 forming, for example, a substantially octagonal shape for engaging an upper end of the handguard adaptor 1600 which may have a complementary shape, such as an octagonal shape, for providing a mating fit between the handguard adaptor 1600 and the spring sleeve 1400 when the biasing member presses the spring sleeve 1400 away from the upper receiver 1102. As further shown in FIGS. 10 and 13, the spring sleeve 1400 has profiles 1440 on the top thereof for allowing clearance of the handguard 1650 over the coupling mechanism 1110. Referring to FIGS. 2-3, when the coupling mechanism 1110 is used in conjunction with the handguard adaptor 1600, upper surfaces 1620 of the handguard adaptor 1600 are covered by the spring sleeve 1400, as shown in FIGS. 1-3 and 21, and in particular are covered by the interior surface 1408 and the lips 1430 of the spring sleeve 1400, which prevents dust and debris from entering the coupling mechanism/assembly 1110. Referring to FIGS. 10-11, the spring sleeve 1400 has an upper lip 1450 such that, when the ball bearings 1300 are out of the divots 1406, the ball bearings 1300 abut the upper lip 1450. As shown in FIGS. 10-11, 23, and 28, the spring sleeve 1400 also includes an aperture 1460 for receiving a set screw or other fastener to secure the spring sleeve 1400 to the upper receiver 1102.

The components of the coupling mechanism 1100 described could be manufactured with a number of high-strength materials such as stainless steel, 4140 high tensile steel, B7 alloy steel and titanium. One of ordinary skill in the art will recognize that other materials could be used as well.

The present invention may be embodied in other specific forms without departing from its spirit or essential characteristics. The described embodiments are to be considered in all respects only as illustrative and not restrictive. The scope of the invention will be, therefore, indicated by claims rather than by the foregoing description. All changes, which come within the meaning and range of equivalency of the claims, are to be embraced within their scope.

The invention claimed is:

1. A firearm system comprising:

an upper receiver, the upper receiver having a free end, the free end having first threads circumscribing an outer section thereof;

a bearing case comprising an upper member and a lower member, the upper member having an inner diameter less than an inner diameter of the lower member such that an upper surface is formed therebetween, the lower member having a plurality of slots formed therein, the upper member having second threads circumscribing an inner section thereof, the bearing case operably coupled to the upper receiver free end by engagement of the first and second threads;

a plurality of bearings, each bearing positioned within each slot;

a spring sleeve circumscribing the bearing case, a biasing member and the bearings, the spring sleeve having a pocket engaged with the biasing member, and the upper member integrally formed with the lower member, the lower member having an inner surface with notches engageable with the bearings; and a barrel having an upper end, an opposing lower end, a longitudinal axis, a groove therebetween for receiving a first fastener, and a plurality of dimples for receiving the bearings;

wherein in an engaged state, the upper end of the barrel is positioned within the bearing case such that each bearing is positioned within a corresponding dimple such that the upper receiver and barrel are substantially aligned.

2. The firearm system of claim 1, wherein each slot of the bearing case extends through the lower member such that a corresponding bearing is at least partially extendable therethrough.

3. The firearm system of claim 1, wherein the lower member of the bearing case has a curved inner lip for receiving the upper end of the barrel.

4. The firearm system of claim 3, further comprising a dust cover engageable with the spring sleeve to form a substantial seal.

5. The firearm system of claim 4, wherein at least one of the spring sleeve and the dust cover has a longitudinally extending aperture for receiving a gas tube passing therethrough.

6. The firearm system of claim 3, further comprising:

a handguard; and a handguard adaptor;

wherein the first fastener is secured into the groove on the barrel to prevent at least one of the handguard and the handguard adaptor from moving longitudinally.

7. The firearm system of claim 6, wherein handguard further comprises at least one aperture extending radially therethrough such that a second fastener is disposed therein to secure the handguard to the handguard adaptor.

8. The firearm system of claim 6, wherein the handguard adaptor further comprises at least one aperture extending radially therethrough such that a second fastener is disposed therein to secure the handguard adaptor to the barrel.

9. The firearm system of claim 6, wherein the lower member of the bearing case has a first predetermined exterior shape; and wherein an upper member of the handguard adaptor has a second predetermined exterior shape complementary with the first predetermined exterior shape, thereby forming a substantial seal when the upper member of the handguard adaptor substantially abuts the lower member of the bearing case.

10. The firearm system of claim 6, wherein the handguard has a longitudinally extending aperture for receiving a gas tube passing therethrough.

11. A firearm system comprising:

an upper receiver, the upper receiver having a free end, the free end having first threads circumscribing an outer section thereof;

a bearing case comprising an upper member and a lower member, the upper member having an inner diameter less than an inner diameter of the lower member such that an upper surface is formed therebetween, the lower member having a plurality of slots formed therein, the upper member having second threads circumscribing an inner section thereof, the bearing case operably coupled to the upper receiver free end by engagement of the first and second threads;

a plurality of bearings, each bearing positioned within each slot;

a spring sleeve circumscribing the bearing case, a biasing member and the bearings, the spring sleeve having a pocket engaged with the biasing member, and the upper member integrally formed with the lower member, the lower member having an inner surface with notches engageable with the bearings;

a dust cover engageable with the spring sleeve to form a substantial seal; a barrel having an upper end, an opposing lower end, a longitudinal axis, a groove therebetween for receiving a first fastener, and a plurality of dimples for receiving the bearings; a handguard; and a handguard adaptor;

wherein the first fastener is secured into the groove on the barrel to prevent at least one of the handguard and the handguard adaptor from moving longitudinally; and wherein in an engaged state, the upper end of the barrel is positioned within the bearing case such that each bearing is positioned within a corresponding dimple such that the upper receiver and barrel are substantially aligned.

12. The firearm system of claim 11, wherein each slot of the bearing case extends through the lower member such that a corresponding bearing is at least partially extendable therethrough.

13. The firearm system of claim 11, wherein handguard further comprises at least one aperture extending radially therethrough such that a second fastener is disposed therein to secure the handguard to the handguard adaptor.

14. The firearm system of claim 11, wherein the handguard adaptor further comprises at least one aperture extending radially therethrough such that a second fastener is disposed therein to secure the handguard adaptor to the barrel.

15. The firearm system of claim 11, wherein the lower member of the bearing case has a first predetermined exterior shape; and wherein an upper member of the handguard adaptor has a second predetermined exterior shape complementary with the first predetermined exterior shape, thereby forming a substantial seal when the upper member of the handguard adaptor substantially abuts the lower member of the bearing case.

16. A method for using a firearm system having an upper receiver and a barrel, the barrel having an upper end with a dimple, the method comprising:

providing a bearing case having a slot for receiving a bearing;

attaching the bearing case to an upper end of the upper receiver;

providing a spring sleeve circumscribing the bearing case, the spring sleeve having an upper member integrally formed with a lower member, the lower member having an inner surface with a notch therein engaging the bearing when the spring sleeve is in a first position, and the inner surface applying an inward radial pressure on the bearing in the slot when the spring sleeve is in a second position;

moving the spring sleeve toward the upper receiver, thereby moving the spring sleeve away from the bearing to allow the bearing to move radially outward from the slot a minimal distance;

inserting the barrel into the bearing case until the dimple engages the bearing, thereby moving the bearing radially inward; and moving the spring sleeve away from the upper receiver to the spring sleeve towards the bearing to move the bearing radially inward, thereby securing the barrel in the bearing case.

17. The method of claim 16, further comprising:

providing a dust cover circumscribing the spring sleeve.

18. The method of claim 16, further comprising:

fastening a handguard to a groove of the barrel by a fastener.

19. The method of claim 16, further comprising:

moving the spring sleeve toward the upper receiver, thereby moving the spring sleeve away from the bearing to allow the bearing to move radially outward from the slot a minimal distance; and moving the barrel longitudinally away from the bearing case until the dimple disengages the bearing, thereby disengaging the barrel from the upper receiver.

* * * * *